US008366530B1

(12) United States Patent
Boeru

(10) Patent No.: US 8,366,530 B1
(45) **Date of Patent: *Feb. 5, 2013**

(54) CUBE INSERTION GAME

(76) Inventor: Ioan Boeru, Houston, TX (US)

( * ) Notice: Subject to any disclaimer, the term of this patent is extended or adjusted under 35 U.S.C. 154(b) by 153 days.

This patent is subject to a terminal disclaimer.

(21) Appl. No.: 12/877,050

(22) Filed: Sep. 7, 2010

Related U.S. Application Data

(60) Division of application No. 11/086,899, filed on Mar. 22, 2005, now Pat. No. 7,789,391, which is a continuation-in-part of application No. 10/154,882, filed on May 24, 2002, now Pat. No. 6,878,059.

(60) Provisional application No. 60/293,712, filed on May 25, 2001.

(51) Int. Cl.
*A63F 9/08* (2006.01)
*A63F 13/00* (2006.01)

(52) U.S. Cl. ..... 463/9; 273/153 R; 273/153 S

(58) Field of Classification Search ..... 463/9, 14–15; 273/236–291, 153 R–153 J, 153 S
See application file for complete search history.

(56) References Cited

U.S. PATENT DOCUMENTS

| | | | | |
|---|---|---|---|---|
| 5,423,556 | A * | 6/1995 | Latypov | 463/9 |
| 6,161,832 | A * | 12/2000 | Holahan et al. | 273/241 |
| 6,878,059 | B2 * | 4/2005 | Boeru | 463/9 |
| D618,291 | S * | 6/2010 | Stott | D21/478 |
| 7,785,181 | B2 * | 8/2010 | Sasaki et al. | 463/9 |
| 7,789,391 | B2 * | 9/2010 | Boeru | 273/153 S |
| 2002/0175472 | A1 * | 11/2002 | Boeru | 273/441 |
| 2005/0164758 | A1 * | 7/2005 | Boeru | 463/9 |

* cited by examiner

*Primary Examiner* — Peter DungBa Vo
*Assistant Examiner* — Bach Hoang
(74) *Attorney, Agent, or Firm* — Kenneth A. Roddy

(57) ABSTRACT

An electronic insertion type game system wherein an image of a game cube formed of a plurality smaller cubes, some of which are scoring cubes, arranged in a generally cubic center array having six square faces is displayed on an electronic display and players operating user input devices simulate inserting a smaller cube into the game cube, forcing another smaller cube to be ejected from the opposite side of the game cube. A score is tallied for a player when a scoring cube is ejected from the frame.

12 Claims, 40 Drawing Sheets

START 0°

ROTATED 10°

ROTATED 20°

ROTATED 30°

ROTATED 40°

ROTATED 50°

ROTATED 80°

ROTATED 60°

ROTATED 90°

ROTATED 70°

FIG. 14

```
Module2 - 1

Sub Macro1()
'
' Macro1 Macro
' Macro recorded 9/1/97 by Ioan Boeru
'

'
    Range("AQ23").Select
    Selection.Copy
    Range("AU19").Select
    Selection.PasteSpecial Paste:=xlValues, Operation:=xlNone, SkipBlanks:= _
        False, Transpose:=False
    Range("AU19").Select
    Application.CutCopyMode = False
    Selection.Copy
    Range("L28").Select
    Selection.PasteSpecial Paste:=xlValues, Operation:=xlAdd, SkipBlanks:= _
        False, Transpose:=False
    Range("AK29").Select
    Application.CutCopyMode = False
    Selection.Copy
    Range("AQ23").Select
    Selection.PasteSpecial Paste:=xlValues, Operation:=xlNone, SkipBlanks:= _
        False, Transpose:=False
    Range("AE35").Select
    Application.CutCopyMode = False
    Selection.Copy
    Range("AK29").Select
    Selection.PasteSpecial Paste:=xlValues, Operation:=xlNone, SkipBlanks:= _
        False, Transpose:=False
    Range("Y41").Select
    Application.CutCopyMode = False
    Selection.Copy
    Range("AE35").Select
    Selection.PasteSpecial Paste:=xlValues, Operation:=xlNone, SkipBlanks:= _
        False, Transpose:=False
    Range("S47").Select
    Application.CutCopyMode = False
    Selection.Copy
    Range("Y41").Select
    Selection.PasteSpecial Paste:=xlValues, Operation:=xlNone, SkipBlanks:= _
        False, Transpose:=False
    Range("R46").Select
    Application.CutCopyMode = False
    Selection.Copy
    Range("S47").Select
    Selection.PasteSpecial Paste:=xlValues, Operation:=xlNone, SkipBlanks:= _
        False, Transpose:=False
End Sub
```

FIG. 15

```
Module5 - 1

Sub Macro19()
'
' Macro19 Macro
' Macro recorded 12/18/97 by Ioan Boeru
'

'
    Range("AQ23").Select
    Selection.Copy
    Range("AU19").Select
    Selection.PasteSpecial Paste:=xlValues, Operation:=xlNone, SkipBlanks:= _
        False, Transpose:=False
    Application.CutCopyMode = False
    Selection.Copy
    Range("BK28").Select
    Selection.PasteSpecial Paste:=xlValues, Operation:=xlAdd, SkipBlanks:= _
        False, Transpose:=False
    Range("AK29").Select
    Application.CutCopyMode = False
    Selection.Copy
    Range("AQ23").Select
    Selection.PasteSpecial Paste:=xlValues, Operation:=xlNone, SkipBlanks:= _
        False, Transpose:=False
    Range("AE35").Select
    Application.CutCopyMode = False
    Selection.Copy
    Range("AK29").Select
    Selection.PasteSpecial Paste:=xlValues, Operation:=xlNone, SkipBlanks:= _
        False, Transpose:=False
    Range("Y41").Select
    Application.CutCopyMode = False
    Selection.Copy
    Range("AE35").Select
    Selection.PasteSpecial Paste:=xlValues, Operation:=xlNone, SkipBlanks:= _
        False, Transpose:=False
    Range("S47").Select
    Application.CutCopyMode = False
    Selection.Copy
    Range("Y41").Select
    Selection.PasteSpecial Paste:=xlValues, Operation:=xlNone, SkipBlanks:= _
        False, Transpose:=False
    Range("V50").Select
    Application.CutCopyMode = False
    Selection.Copy
    Range("S47").Select
    Selection.PasteSpecial Paste:=xlValues, Operation:=xlNone, SkipBlanks:= _
        False, Transpose:=False
End Sub
```

CUBE INSERTION GAME

CROSS REFERENCE TO RELATED APPLICATIONS

This application is a divisional of and claims priority of U.S. patent application Ser. No. 11/086,899, filed Mar. 22, 2005, now U.S. Pat. No. 7,789,391, which is a Continuation-In-Part of U.S. patent application Ser. No. 10/154,882, filed May 24, 2002, now U.S. Pat. No. 6,878,059, which claimed priority of U.S. Provisional Patent Application Ser. No. 60/293,712 filed May 25, 2001.

BACKGROUND OF THE INVENTION

Numerous mechanical games and puzzles have been devised which comprise a basic 3-dimensional cubic structure. Many of these games, like the one shown in U.S. Pat. No. 5,613,681, are essentially 3-dimensional adaptations of the popular 2-dimensional children's game known as "Tic-Tac-Toe" or "Naughts and Crosses". The '681 patent discloses a game comprising a frame for resiliently retaining up to 27 spherical balls in a 3×3×3 array. The balls are inserted into the frame, and the "score" of the game is dependent on the arrangement of the balls within the frame. If any of the balls are ejected from the frame during game play, they are not considered in the scoring.

The game of the present invention comprises a frame which resiliently retains a plurality of game pieces in a 3-dimensional array. The present invention is distinguished from the prior art in that the scoring of the game is not dependent on the arrangement of the pieces within the frame, but rather on which pieces are ejected from the frame on each turn.

SUMMARY OF THE INVENTION

The physical embodiment of the game comprises a frame and 82 cubical playing pieces, or playing cubes, removably retained in the frame. All the cubes are the same length per side, this length being defined as the unit length, and preferably being approximately 2 inches. Preferably the cubes are constructed of plastic or any other suitably rigid, durable, lightweight material. For playing purposes, the playing cubes are divided into 3 groups: 27 scoring cubes, 54 blank cubes, and 1 pilot cube. During play, as will be described below, cubes are inserted into the frame, forcing another cube to be ejected from the opposite side of the cube. The cube edges are preferably rounded or chamfered to facilitate movement relative to each other and to the frame.

Each of the 27 scoring cubes includes removable marking means for marking a single side of the cube. Preferably the marking means comprises a circular recess in the side of the cube, and color-coded circular button which is removably installable in the recess. The blank and pilot cubes are essentially identical to the scoring cubes, except that the there is no need for marking means on the blank cubes.

The frame comprises 12 elongate legs rigidly attached to each other to define the edges of a frame cube approximately 5 units in length per side. The cross section of each leg is a square approximately 1 unit in length per side. Therefore, there are 7 different volumes defined within the frame for receiving the playing cubes. The center volume in the center of the frame measures 3×3×3 units. The 6 side volumes each measure 3×3×1 units, and each side volume is disposed on one side of the frame cube between the 4 legs forming that side. The frame also comprises retention means for removably retaining the playing cubes within the frame.

Before assembling the cubes in the frame for play, a color-coded button is inserted into one recess on each of the 27 scoring cubes. The playing cubes are loaded into the frame such that the side volumes of the frame contain only blank cubes, and the center volume contains the scoring cubes. Therefore, the blank cubes are divided into 6 separate 3×3 side arrays. The scoring cubes define a 3×3×3 center array, and are arranged such that the marked face of each scoring cube faces ONLY another scoring cube and NOT a blank cube.

In the most basic version of the game, two players take turns inserting a cube into one of the face arrays in the frame. A cube is thereby ejected from the corresponding position in the opposite face array, and all the cubes in that position along that axis are displaces one position. The first player begins by inserted the pilot cube into the center position in any face array. The ejected cube now becomes the new pilot cube. The second player inserts the new pilot cube into the center position of any face array perpendicular to the first face array. After these first two moves, the players may insert the pilot cube into any position in any face array.

When a scoring cube is ejected during a player's turn, that player removes the color-coded button from the scoring cube, and is awarded the value of the button. For the simplest game all the buttons are given a value of 1 point. Once the button has been removed from the scoring cube, the next player uses that cube as the pilot, and the game continues. A player wins the game when he has accumulated a majority of the available points (in this case, 14).

BRIEF DESCRIPTION OF THE DRAWINGS

FIGS. 14 and 15 show listings of two representative macros used in the spreadsheet model of FIG. 12.

DETAILED DESCRIPTION OF THE INVENTION

Physical Construction

Figure 1:
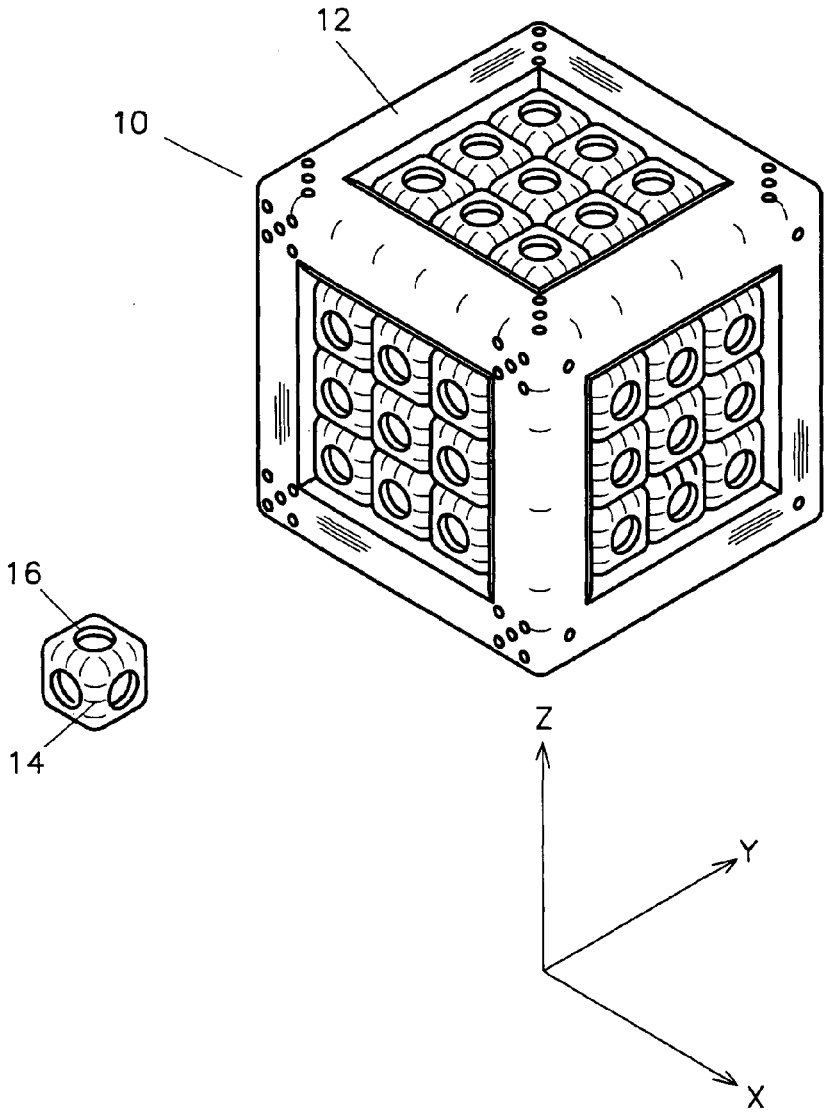
FIG. 1 shows an isometric view of the preferred embodiment game assembled and ready for play.

Referring to FIG. 1, the game 10 comprises a frame 12 and 82 cubical playing pieces, or playing cubes such as 14, removably retained in the frame. All the cubes are approximately the same length per side, this length being defined as the unit length, and preferably being approximately two inches. Preferably the cubes are constructed of plastic or any other suitably rigid, durable, lightweight material. For playing purposes, the playing cubes are divided into three groups: 27 scoring cubes, 54 blank cubes, and one pilot cube. During play, as will be described below, cubes are inserted into the frame, forcing another cube to be ejected from the opposite side of the cube. The cube edges are preferably rounded or chamfered, as shown generally at 16, to facilitate movement relative to each other and to the frame. In other embodiments the playing pieces could have any shape.

Figure 2:
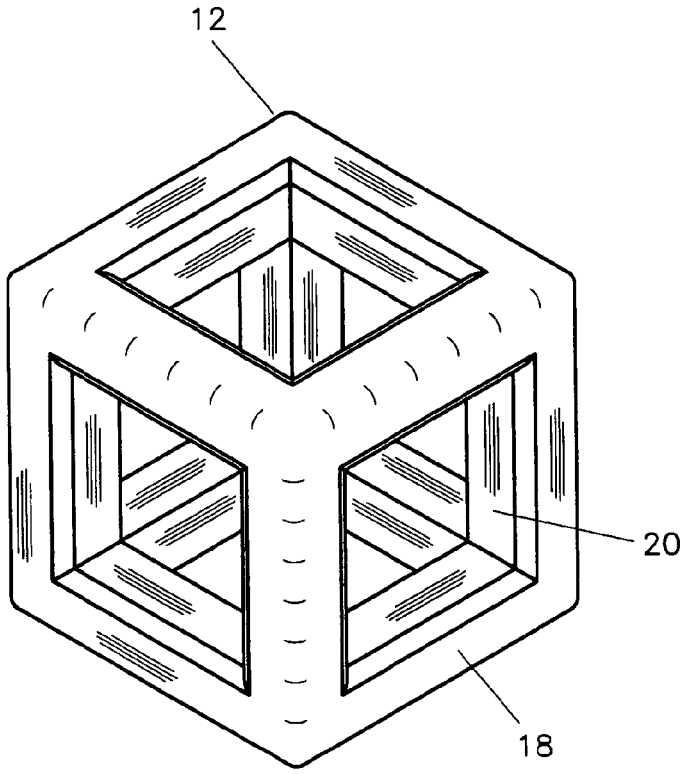
FIG. 2 shows an isometric view of the frame portion of the preferred embodiment game.

Referring to FIG. 2, the frame 12 comprises twelve elongate legs such as 18 rigidly attached to each other to define the edges of a frame cube approximately 5 units in length per side. The cross section of each leg is a square approximately 1 unit in length per side. Therefore, there are 7 different volumes defined within the frame for receiving the playing cubes. The center volume in the center of the frame measures 3×3×3 units. The six side volumes such as 20 each measure 3×3×1 units, and each side volume is disposed on one side of the frame cube between the four legs forming that side. Referring to FIG. 1, the six sides of the frame may be numbered in a manner similar to a gaming die. Sides one and six are opposite each other and are perpendicular to the X-axis of the frame. Sides two and five are opposite each other and are perpendicular to the Y-axis of the frame. Sides three and four are opposite each other and are perpendicular to the Z-axis of the frame.

Figure 3:
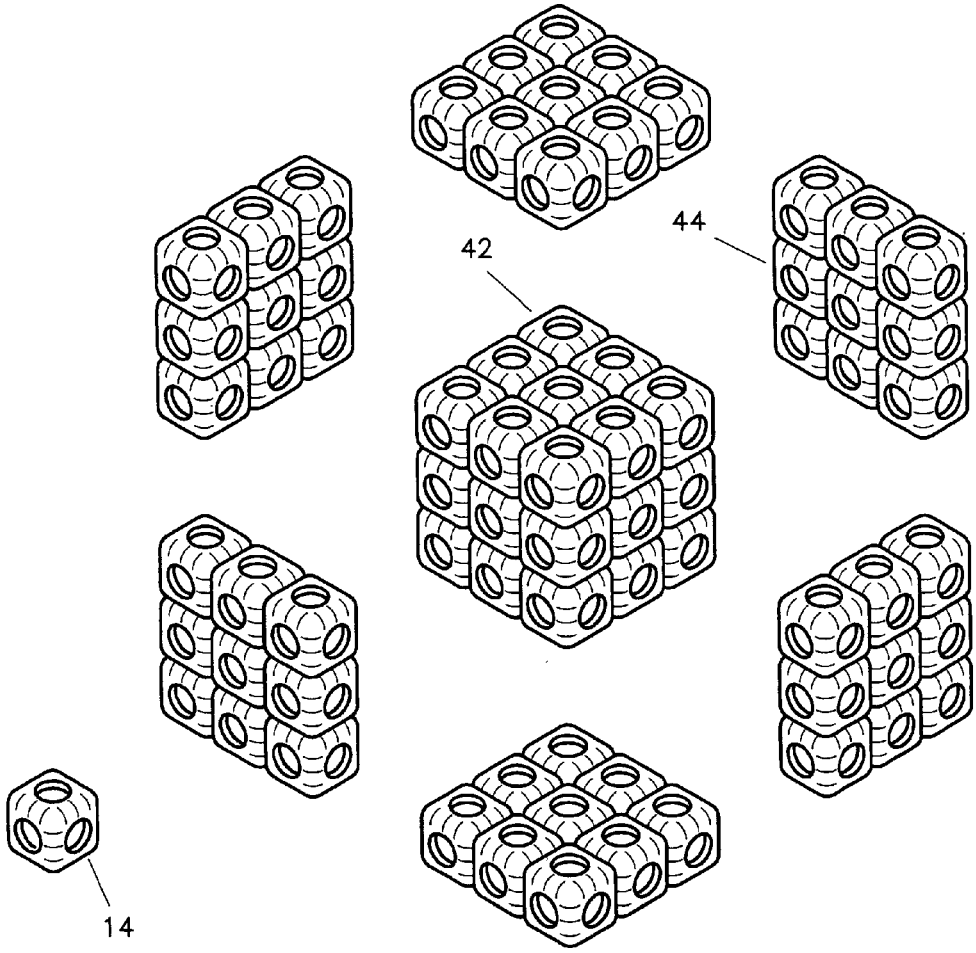
FIG. 3 shows an exploded isometric view of the various cube arrays in the preferred embodiment game.

Referring to FIG. 3, the playing cubes are shown in an exploded view. The 27 scoring cubes are arranged in a 3×3×3 center array 42. During game play this center array is disposed in the center volume defined by the frame. The blank cubes are arranged in six side arrays or face arrays such as 44. During game play each side array is disposed in one of the side volumes 20 defined by the frame.

Figure 4A:
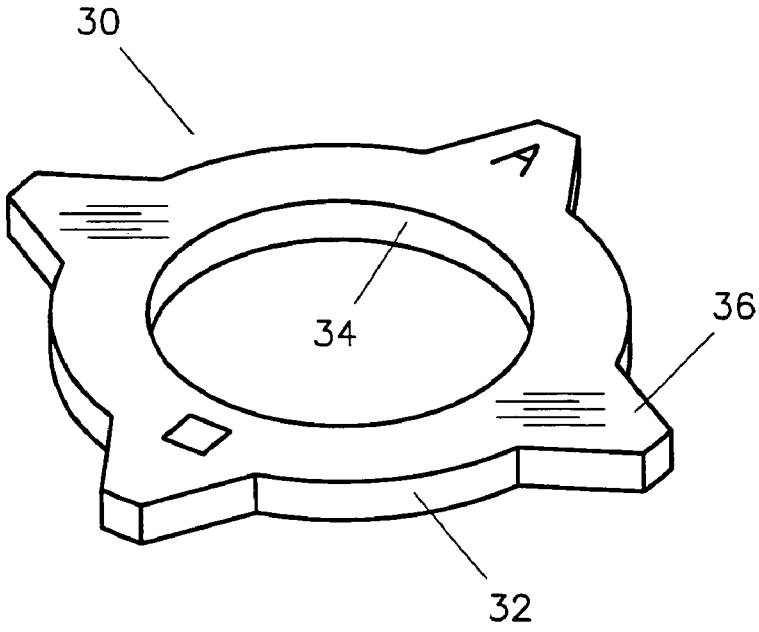
FIGS. 4*a* and 4*b* show isometric views of scoring buttons having four and three teeth, respectively.
Figure 5:
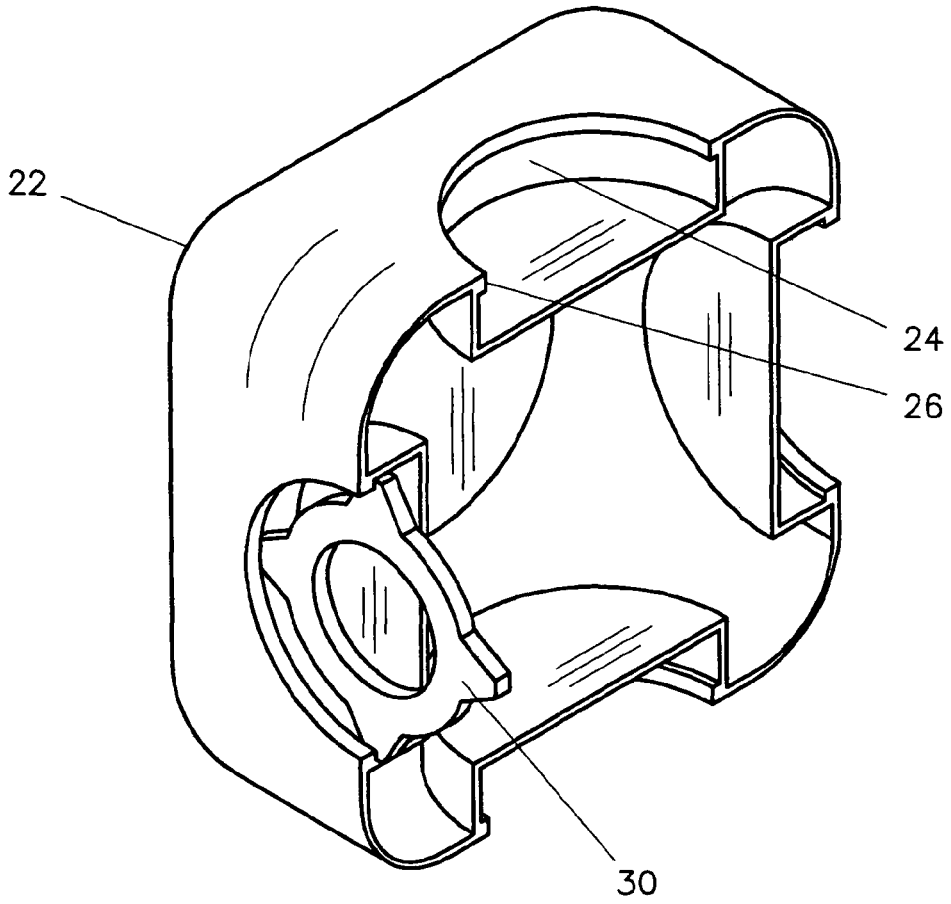
FIG. 5 shows an isometric cutaway view of a preferred embodiment scoring cube with a scoring button installed.

Each of the 27 scoring cubes includes removable marking means for marking a single side of the cube. Referring to FIG. 5, preferably the marking means comprises a circular recess 24 in the side of the cube 20. The recess 24 includes an internal lip 26, and a color-coded circular button 30 may be removably installed in the recess 24, and retained by lip 26. Referring to FIG. 4*a*, the preferred embodiment button 30 comprises an annular body 32, a central aperture 34, and a plurality of retaining tabs 36. The button 30 is shown to include four tabs, although in other embodiments the button may include any number of tabs.

Figure 4B:
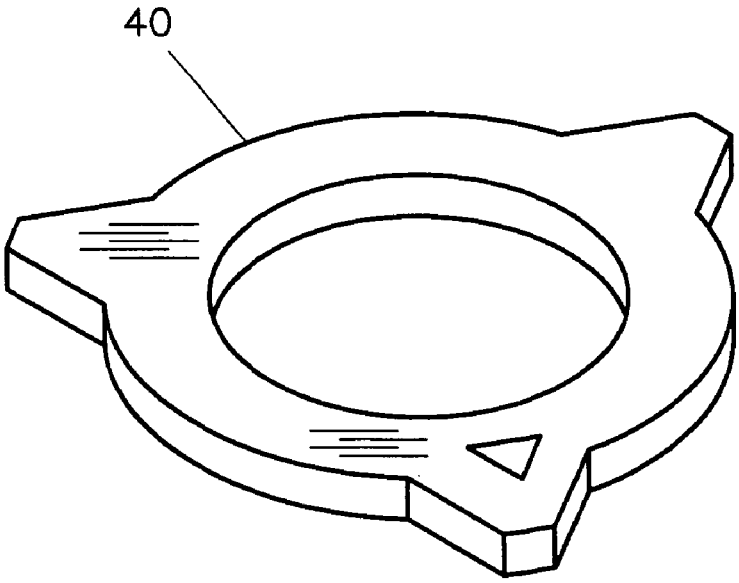
Figure 5A:
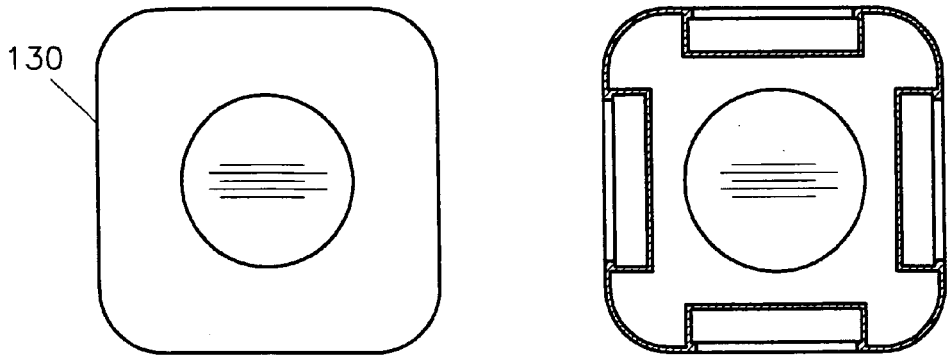
FIG. 5*a* shows a plan and cross-sectional view of a preferred embodiment blank or pilot cube.
Figure 5B:
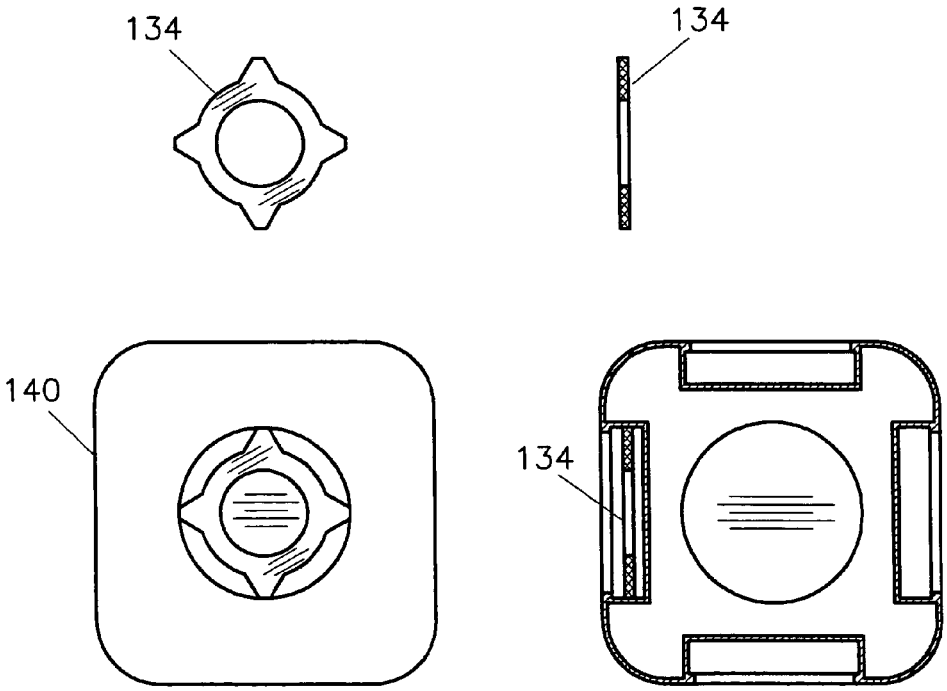
FIG. 5*b* shows a plan and cross-sectional view of a preferred embodiment scoring cube.

Referring to FIG. 4*b*, button 40 includes 3 tabs. The buttons are preferably made of a flexible, compliant material such as foam rubber, which allows the button to be inserted and removed from recess 24 without damage to either the button or the cube. To remove the button 30 from the recess 24, a player may insert a fingertip into the central aperture 34 and pull the button from the recess. To accommodate different modes of play, the buttons may include different and/or additional information, such as alpha-numeric characters, shapes, or other designs. Each scoring cube may be provided with multiple recesses, and preferably each scoring cube is provided with a recess on each of the six sides. The reasons for this preference include ease of play, ease of manufacture, and flexibility in the rules of play, as will be described in more detail below. FIG. 5*b* shows a plan view and a cross-sectional view of a scoring cube 140 with button 134 inserted into one of the recesses.

The blank cubes are essentially identical to the scoring cubes, except that the there is no need for marking means on the blank cubes. For ease of play and ease of manufacture, however, the blank cubes are preferably identical to the scoring cubes, having a recess on each of the six sides. Therefore, the scoring cubes are only distinguishable form the blank cubes when the buttons are installed in the recesses. The pilot cube is also essentially identical to the blank cubes, and is therefore preferably identical to the scoring cubes, having a recess on each of the six sides. FIG. 5*a* shows a plan view and a cross sectional view of pilot or blank cube.

Figure 6:
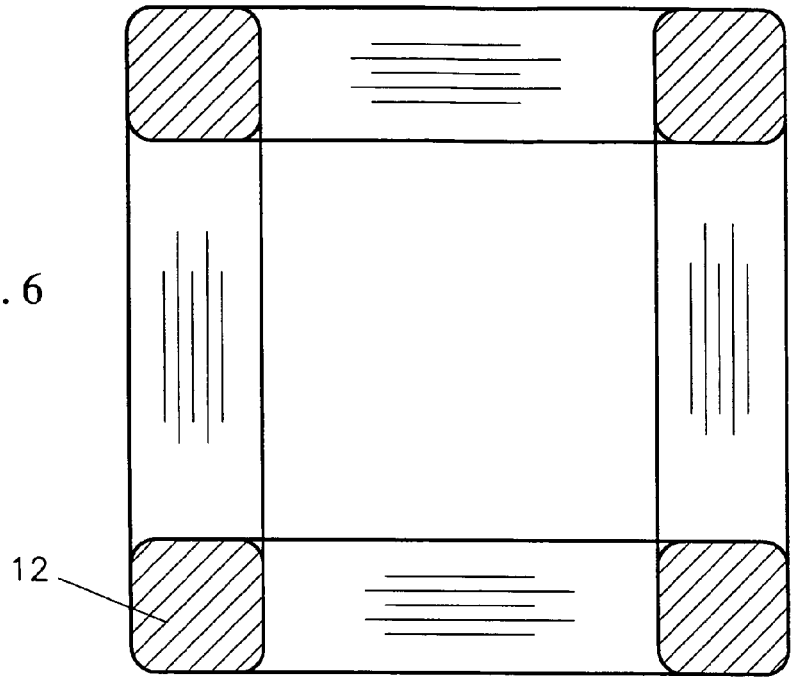
FIG. 6 shows a cross-sectional view of the preferred embodiment frame.
Figure 7:
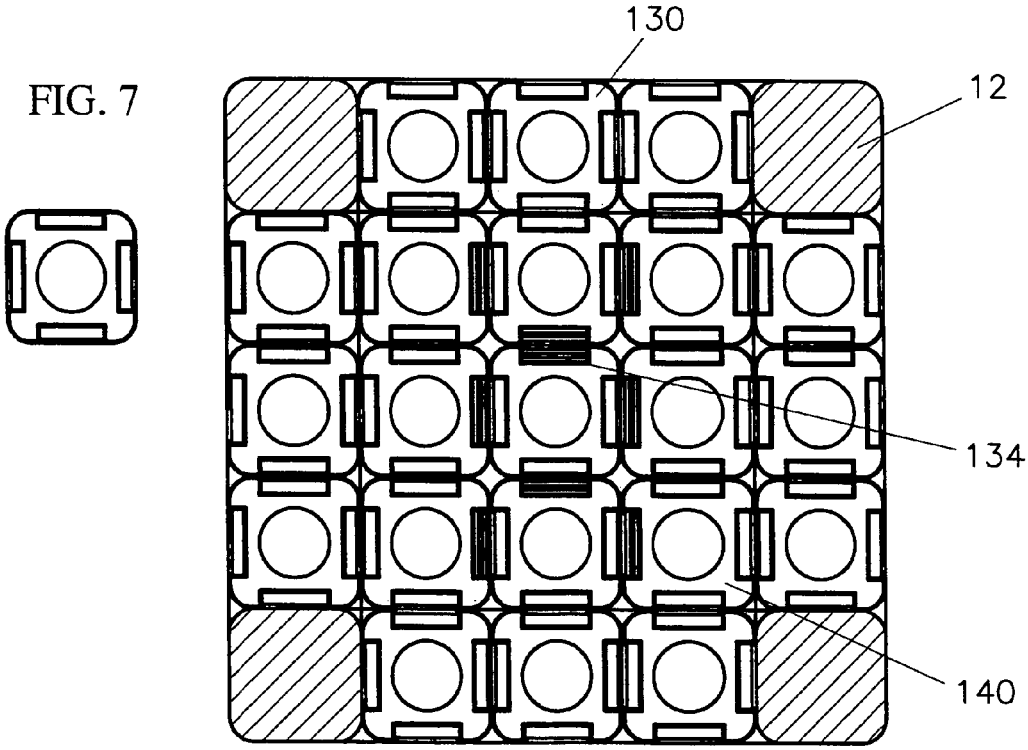
FIG. 7 shows a cross sectional view of the preferred embodiment game assembled for play.
Figure 8:
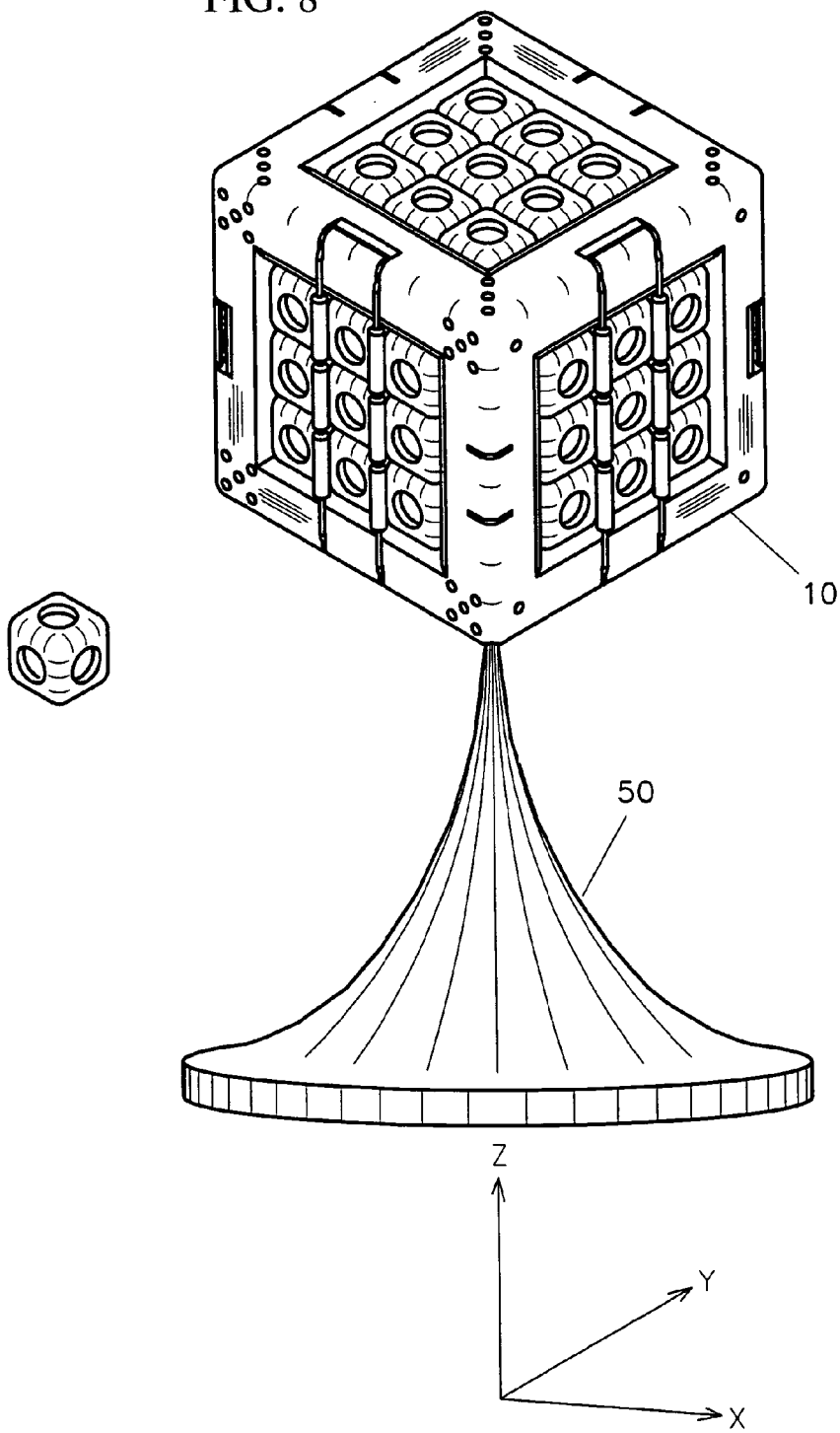
FIG. 8 shows an isometric view of the preferred embodiment game mounted on a stand.

Before assembling the cubes in the frame for play, a color-coded button is inserted into one recess on each of the 27 scoring cubes. The playing cubes are loaded into the frame such that the side volumes of the frame contain only blank cubes, and the center volume contains the scoring cubes. The scoring cubes are arranged such that the marked face of each scoring cube faces ONLY another scoring cube and NOT a blank cube. FIG. 6 shows a cross-sectional view of the frame 12. FIG. 7 shows a cross-sectional view of the game assembled for play. Blank cubes such as 130 are disposed in the side arrays of frame 12. Scoring cubes such as 140 are disposed in the central array. Each scoring cube 140 is provided with button 134. Referring to FIG. 8, the entire game assembly 10 may be rotatably mounted on a stand 50.

Figure 9:
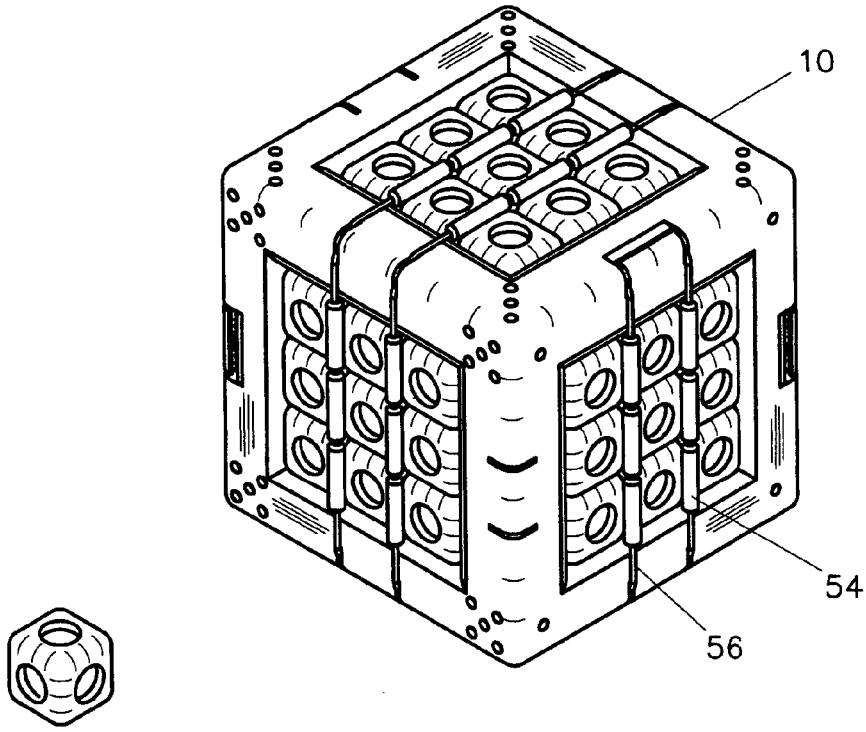
FIG. 9 shows an isometric view of the game with the preferred cube retention means.

Referring to FIG. 9, the frame also comprises retention means for removably retaining the playing cubes within the frame. Preferably the retention means comprises a series of thin cylindrical members 54 mounted on an elastic cord 56, and disposed across the outside surface of each face volume. The openings between the members 54 are slightly smaller than the playing cubes. During play, as a cube is inserted into the frame, the cube directly opposite the inserted cube pushes the cylindrical members 54 apart, and the cube is forced through the grid opening and is ejected from the frame. Since the remaining cubes are not being pushed by the inserted cube, they are retained within the frame by the members 54. The elastic cords may be arranged to span one, two, three, or four faces of the frame. Therefore, various combinations of these arrangements may be used to retain cubes from all sides of the game. If the game is to be mounted as in FIG. 8, only the lower three sides of the frame need to be provided with retaining means.

Figure 10A:
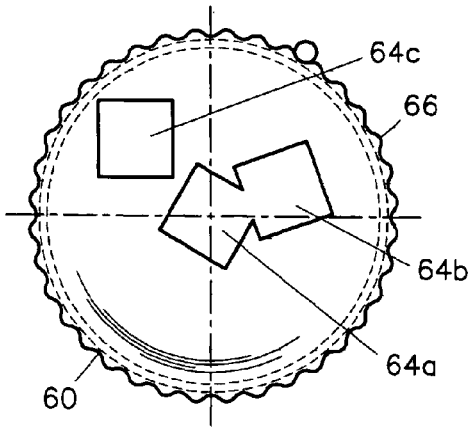
FIGS. 10*a* through 10*k* show plan views of an alternative cube retention means.
Figure 10B:
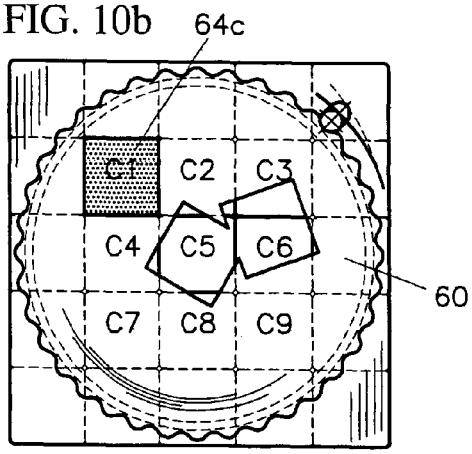
Figure 10C:
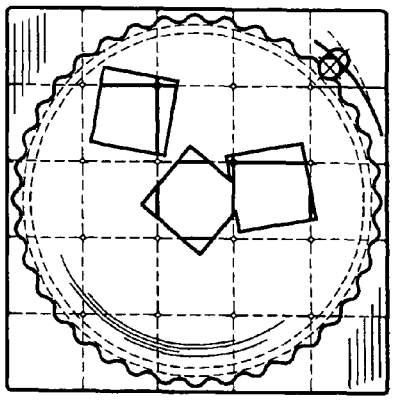
Figure 10D:
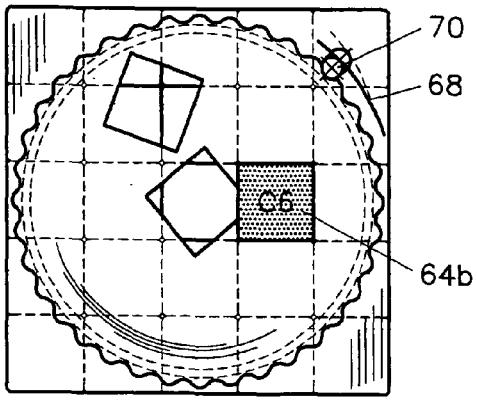
Figure 10E:
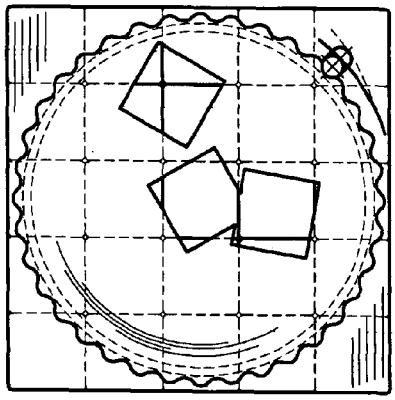
Figure 10F:
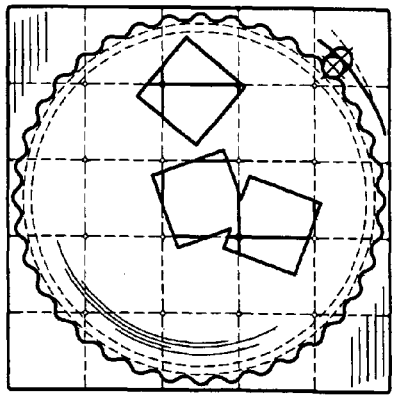
Figure 10G:
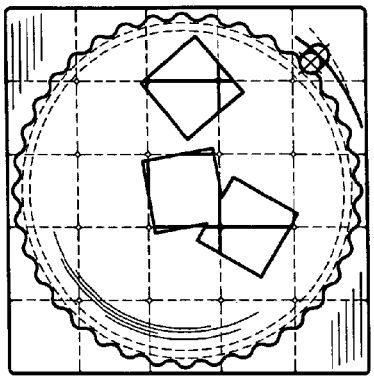
Figure 10J:
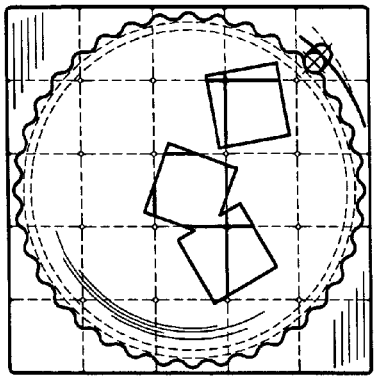
Figure 10H:
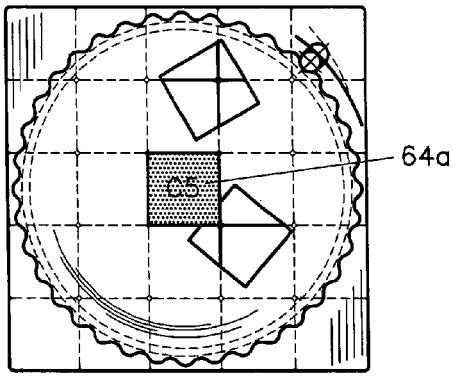
Figure 10K:
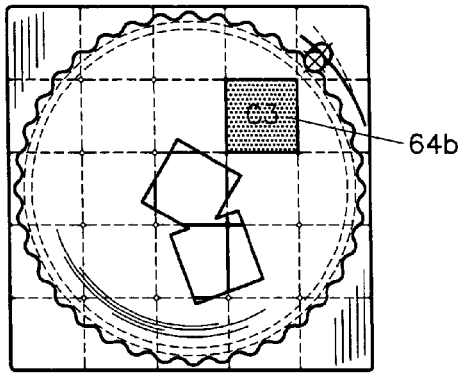
Figure 10I:
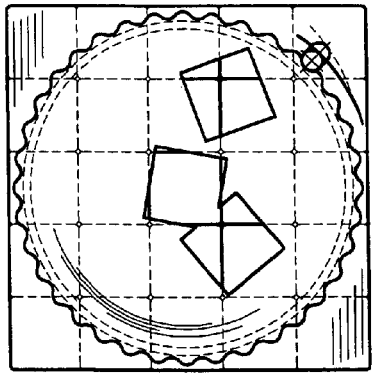

In another embodiment, as shown in FIGS. 10*a* through 10*k*, the retention means comprises a rotatable circular cover 60 mounted over each face of the frame. The cover includes three square openings 64*a*, 64*b*, and 64*c*, which in cooperation allow only one playing cube to pass through the cover at any time. Referring to FIG. 10*a*, when the cover 60 is in a first position representing 0 degrees of rotation, the third opening 64*c* is aligned with the first cube C1 in the side array. After the cover has been rotated through 20 degrees, as shown in FIG. 10*d*, the second opening 64*b* is aligned with cube C6. After the cover has been rotated through 60 degrees, as shown in FIG. 10*h*, the first opening 64*a* is aligned with cube C5. After the cover has been rotated through 90 degrees, as shown in FIG. 10*k*, the third opening 64*c* is aligned with cube C3. It will be understood that as the cover is rotated further, the openings 64*b* and 64*c* will eventually be aligned with each of the remaining cubes in the side array. Referring to FIGS. 10*a* and 10*d*, the cover may be provided with a toothed profile 66 on its outer diameter. The frame may be provided with a detent 70 mounted on a leaf spring 68. The detent engages the teeth 66 to resiliently retain the cover 60 in a particular angular position. The covers on opposite sides of the frame may be geared together through the frame, to provide for synchronous movement of opposing covers. In other embodiments, any suitable means may be employed to removably retain the playing cubes within the frame.

Figure 20:
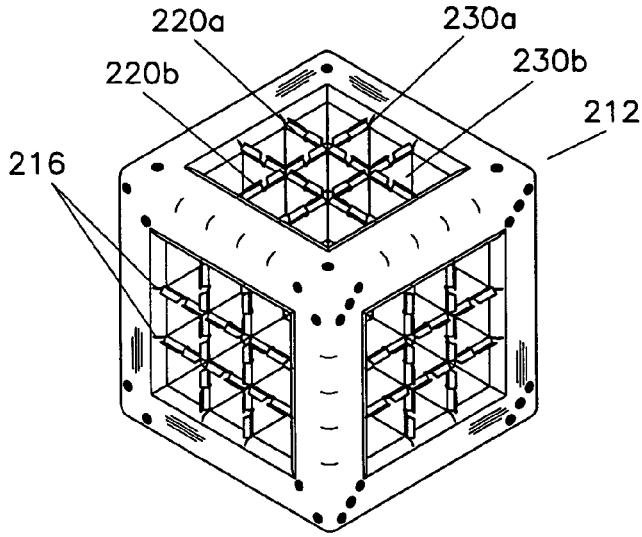
FIG. 20 shows an isometric view of the frame with an alternative leaf spring retention means.
Figure 21:
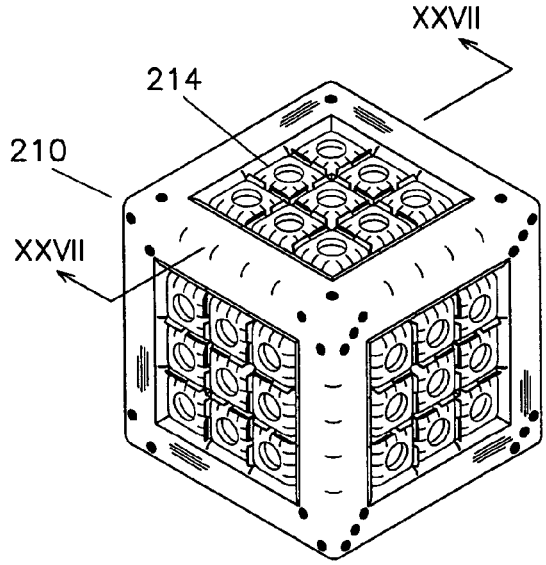
FIG. 21 shows an isometric view of the frame and retention means of FIG. 20, with the playing cubes installed.
Figure 22:
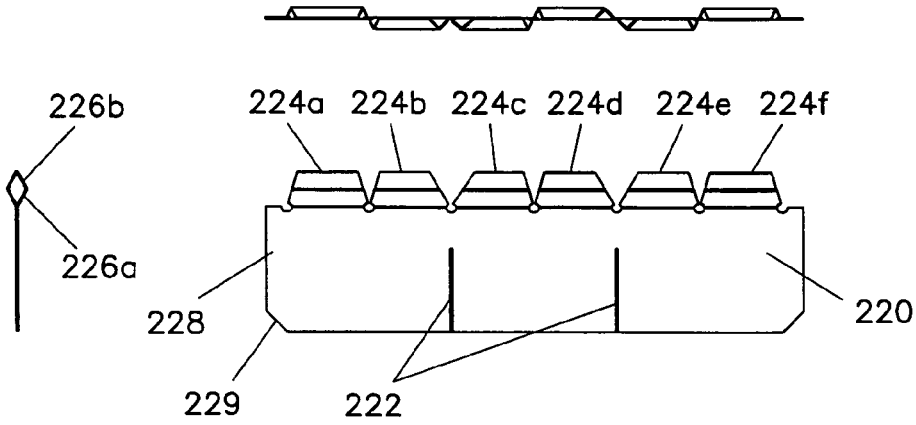
FIGS. 22 through 26 show various views of the leaf spring retention means.

In another embodiment shown in FIG. 20, the game 210 includes retention means comprising a plurality of flat panels such as 220*a*, 220*b*, 230*a* and 230*b* all disposed within slots such as 216 in frame 212. FIG. 21 shows the game 210 with cubes such as 214 installed. Referring to FIG. 22, upper panel 220 comprises a plurality of leaf spring portions 224*a* through 224*f* along its top edge. Panel 220 also includes two long slots 222 extending from the bottom edge, and two end tabs such as 228. Chamfers such as 229 facilitate insertion of end tabs 228 into slots 216 in the frame. Each leaf spring portion 224 includes a first angled leg 226*a* and a second angled leg 226*b*. The angled legs of each leaf spring portion are arranged to flex in an accordion type fashion.

Figure 23:
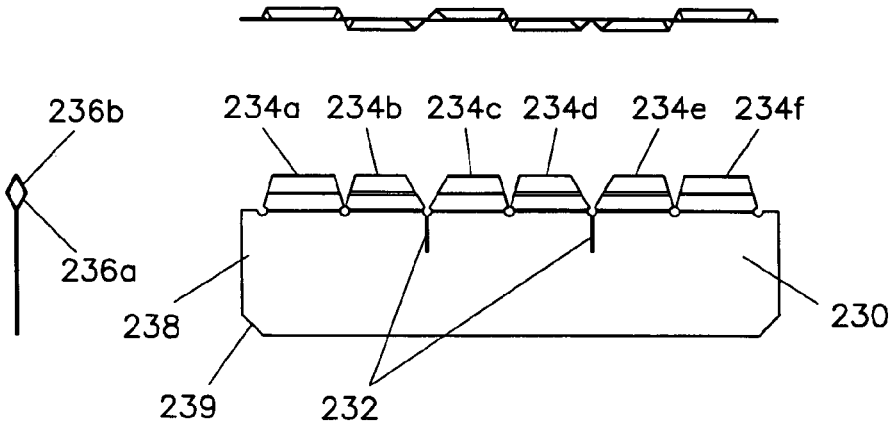

Referring to FIG. 23, lower panel 230 also comprises a plurality of leaf spring portions 234*a* through 234*f* along its top edge. Panel 230 also includes two short slots 232 extending from the top edge, and two end tabs 238 with chamfers 239 for facilitating insertion into the frame. Each leaf spring portion 234 includes a first angled leg 236*a* and a second angled leg 236*b*, arranged to be flexible in an accordion type fashion. Preferably the panels 220 and 230 are made of a durable, resilient material such as plastic. In other embodiments any suitable material may be used, including, but not limited to, metal, laminated paper, or card stock.

Figure 24:
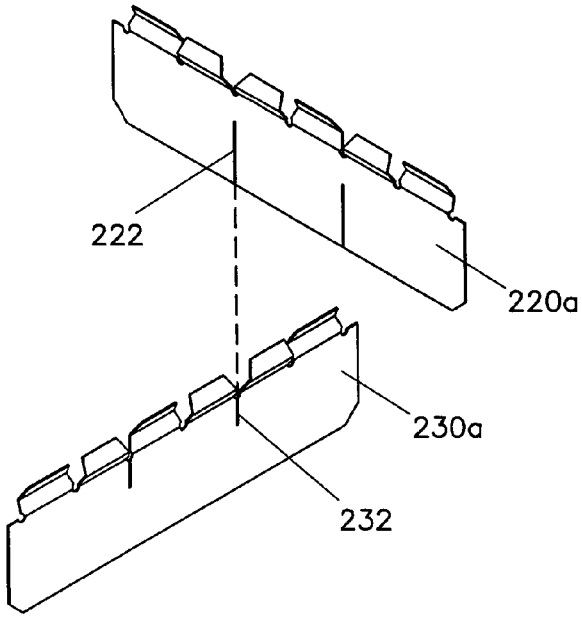
Figure 25:
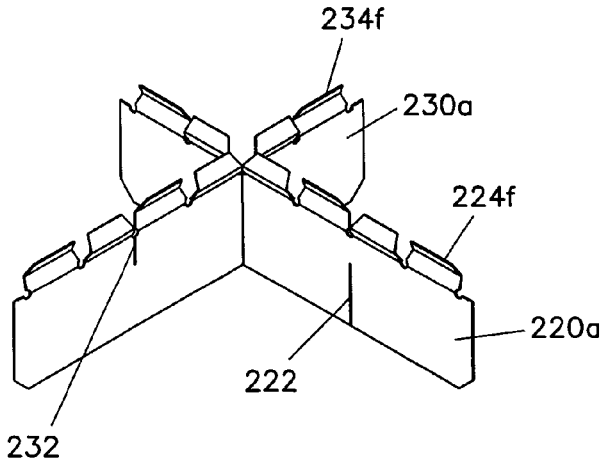
Figure 26:
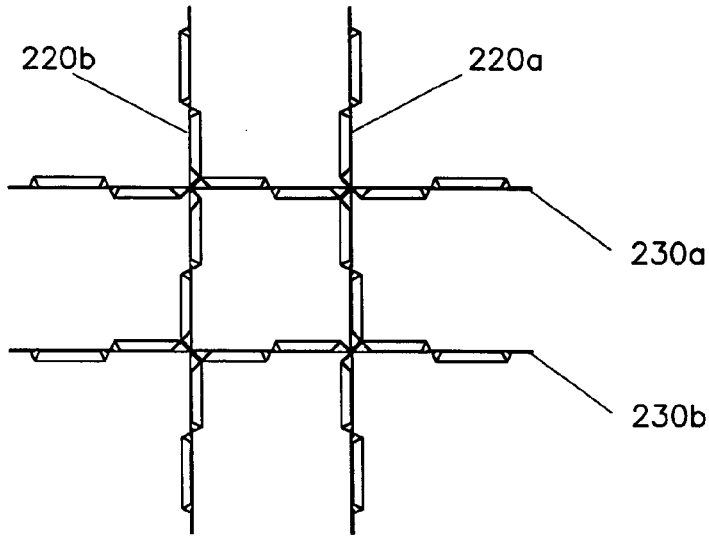
Figure 27:
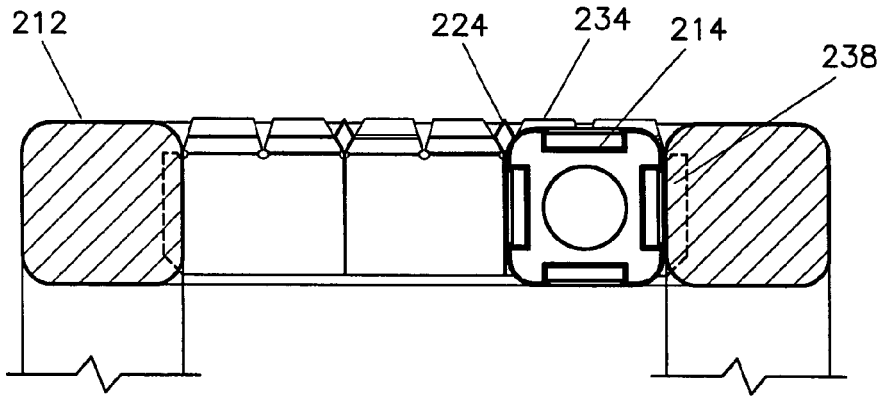
FIG. 27 shows a partial cross-sectional view of the game with the leaf spring retention means.
Figure 28A:
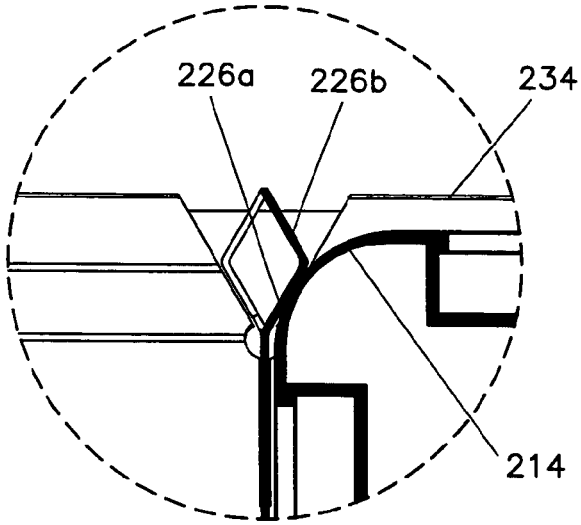
FIGS. 28*a* and 28*b* show close-up views of the leaf spring portion of the retaining means.
Figure 28B:
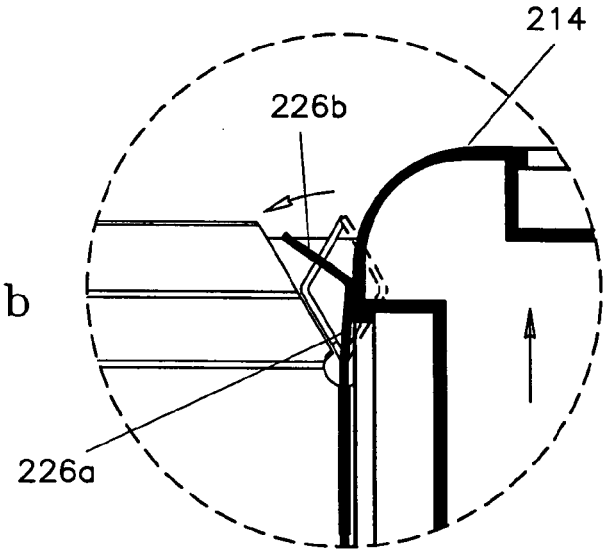

Referring to FIGS. 24 through 26, upper panels such as 220*a* intermesh with lower panels 220*b* via engagement between slots 222 and 232 respectively. Referring to FIG. 27, the panels are shown inserted into frame 212. Cube 214 is retained in the frame 212 by leaf spring portions such as 224 and 234. Referring to FIG. 28*a*, angled portions 226*a* and 226*b* of the leaf spring portion are shown in a first bent position, whereby the cube 214 is retained in the frame. When a sufficient force is applied to the corresponding block on the other side of the frame, the angle portions 226*a* and 226*b* are flexed to a flattened position, which permits ejection of the cube 214 from the frame. The properties of the panel material are such that movement from the bent to the flattened position is substantially within the elastic range of the material, such that the leaf spring portion returns to the bent position after the cube has been ejected. The stiffness of the panel material may be selected such that the force required to eject the cube from the frame is (1) high enough to prevent cubes from simply falling out or being inadvertently ejected, and (2) low enough to allow a player to eject a cube without undue difficulty.

Game Play

Figure 11A:
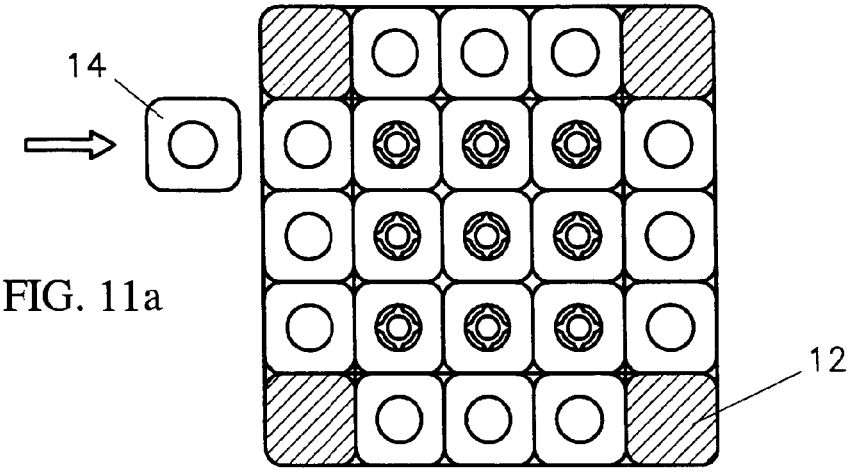
FIGS. 11*a* through 11*c* show a cross-sectional view of the preferred embodiment game as pilot cube is being inserted.
Figure 11B:
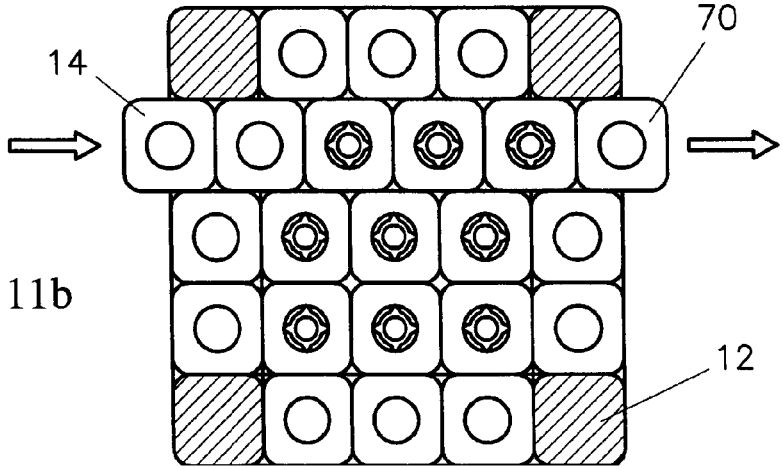
Figure 11C:
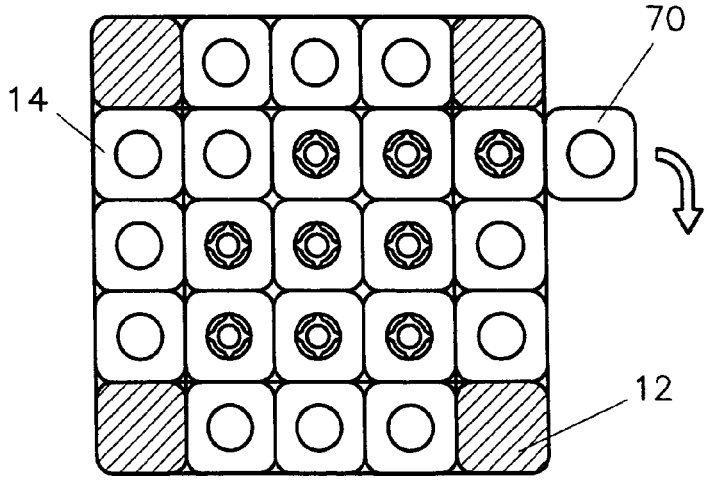

Referring to FIGS. 11*a* through 11*c*, in the most basic version of the game, two players take turns inserting a pilot cube 14 into one of the face arrays in the frame 12. Another cube 70 is thereby ejected from the corresponding position in the opposite face array, and all the cubes in that position along that axis are displaces one position. The first player begins by inserted the pilot cube into the center position in any face array. The ejected cube now becomes the new pilot cube. The second player inserts the new pilot cube into the center position of any face array perpendicular to the first face array. After these first two moves, the players may insert the pilot cube into any position in any face array.

When a scoring cube is ejected during a player's turn, that player removes the color-coded button from the scoring cube, and is awarded the value of the button. For the simplest game all the buttons are given a value of 1 point. Once the button has been removed from the scoring cube, the next player uses that cube as the pilot, and the game continues. A player wins the game when he has accumulated a majority of the available points (in this case, 14).

In other modes of play, the buttons may be given different values, as indicated by different colors, characters, shapes, or designs. Particularly marked buttons may be used to signify special occurrences in the game, such as an extra turn, a loss of turn, a loss of some or all accumulated points, automatic defeat or victory, and many other various special occurrences. In still other modes of play, 2 or more buttons may be installed in each scoring cube.

In still other modes of play, 3 or more players or teams of players may play the game. When the number of players or teams is even or divisible by 3, each player or team may be assigned a particular set of frame faces into which they must insert all their pilot cubes during the game. In another variation, the frame face for each move may be selected at random, such as with a gaming die.

Figure 29:
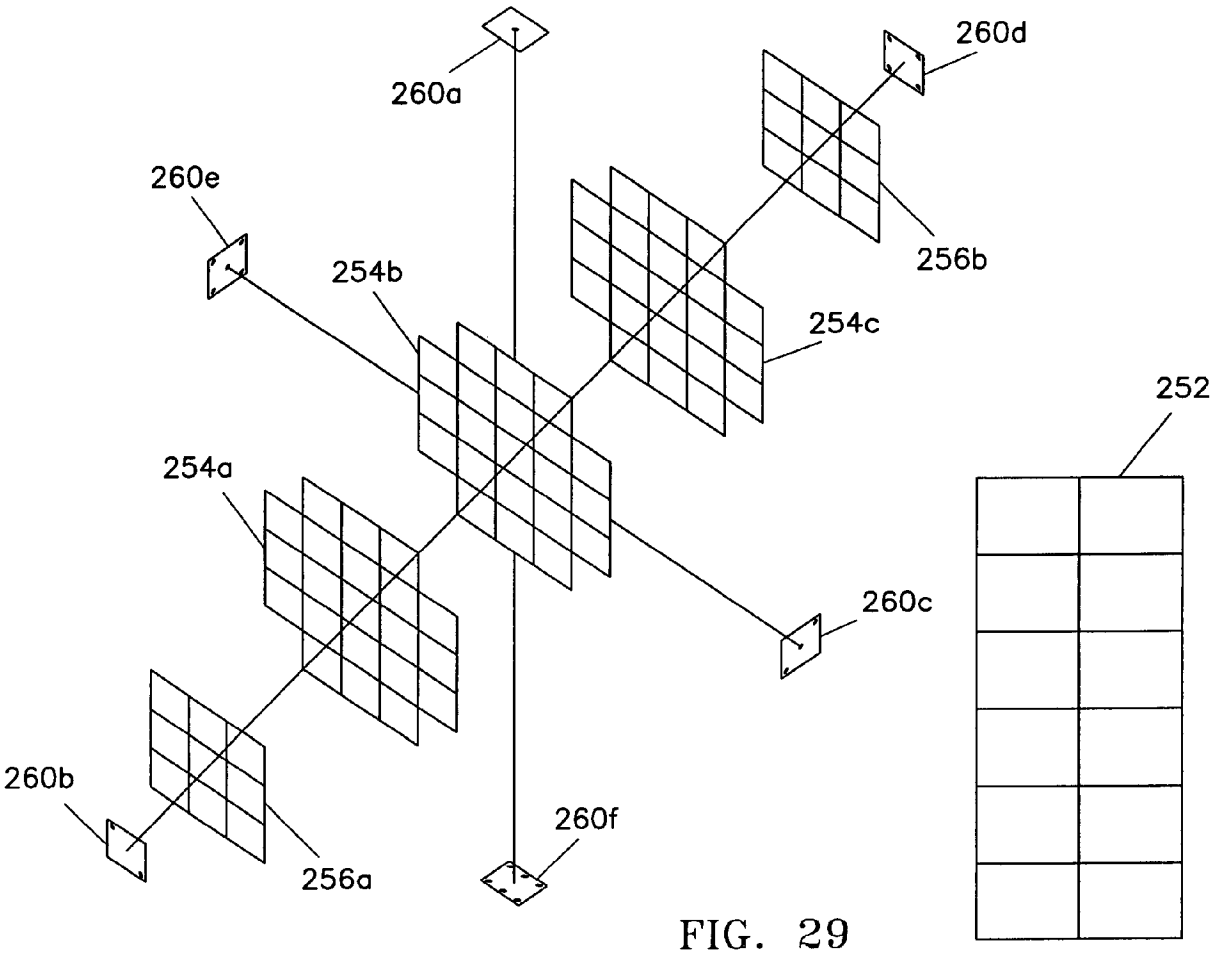
FIG. 29 shows an illustration of a scoring and tracking chart for use with game.

FIG. 29 shows a chart which may be used with any of the mechanical or electronic versions of the game disclosed herein. The chart may be used to monitor the score of the game, and also to track the position of scoring cubes during play. The chart may include face indicators 260*a* through 260*f*, which identify the various faces of the game. Grid 256*a* represents face array two of the game, and similarly grid 256*b* represents face array four. Grids 254*a* through 254*c* represent portions of the center array and the other four face arrays. A player may mark within any of the grids to indicate the location of a scoring cube, or any other appropriate information. General grid 252 may be use to record score, current playing face, or any other appropriate game parameters.

Electronic Versions

Figure 12:
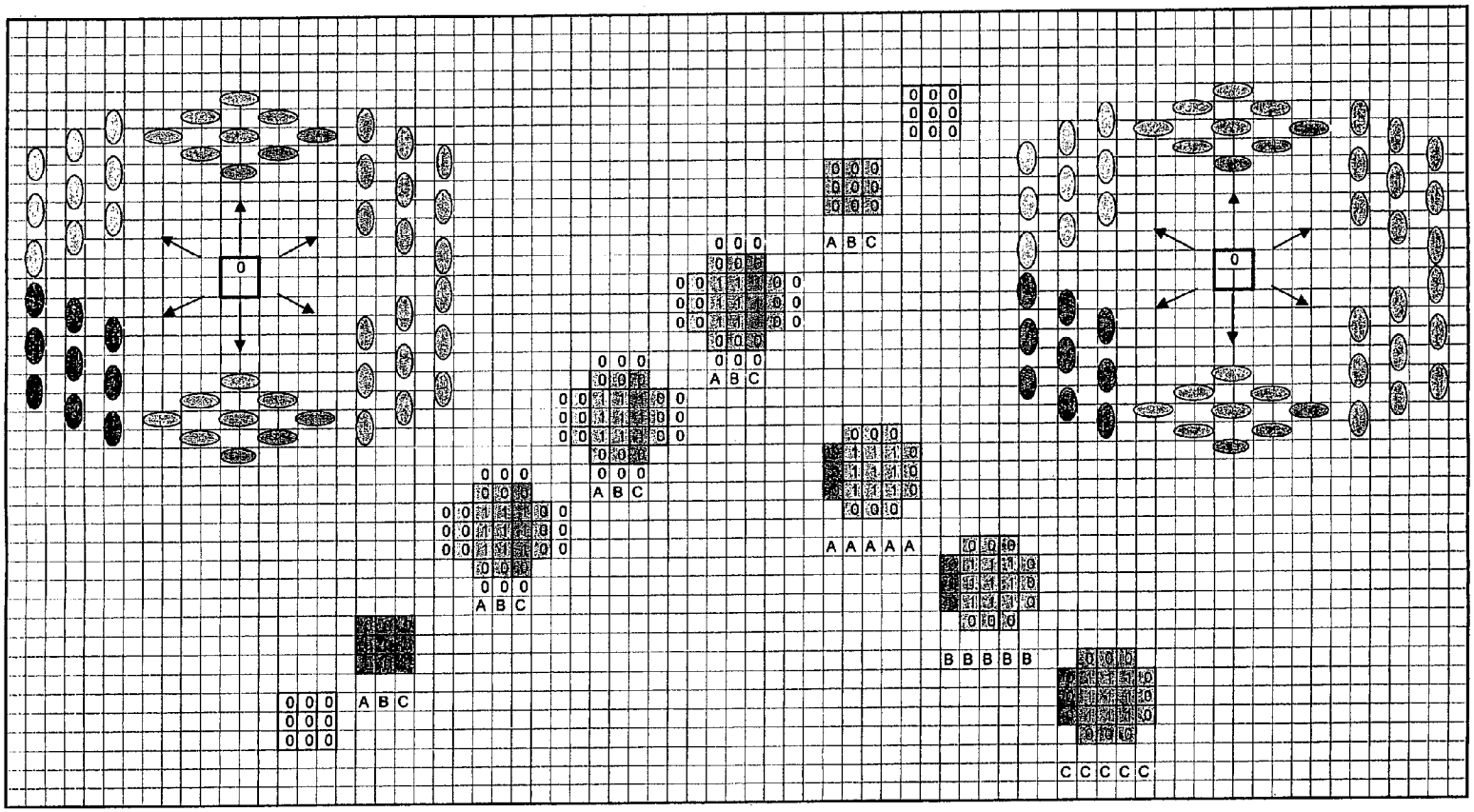
FIG. 12 shows a schematic of the preferred embodiment game modeled on a computer spreadsheet program.
Figure 13:
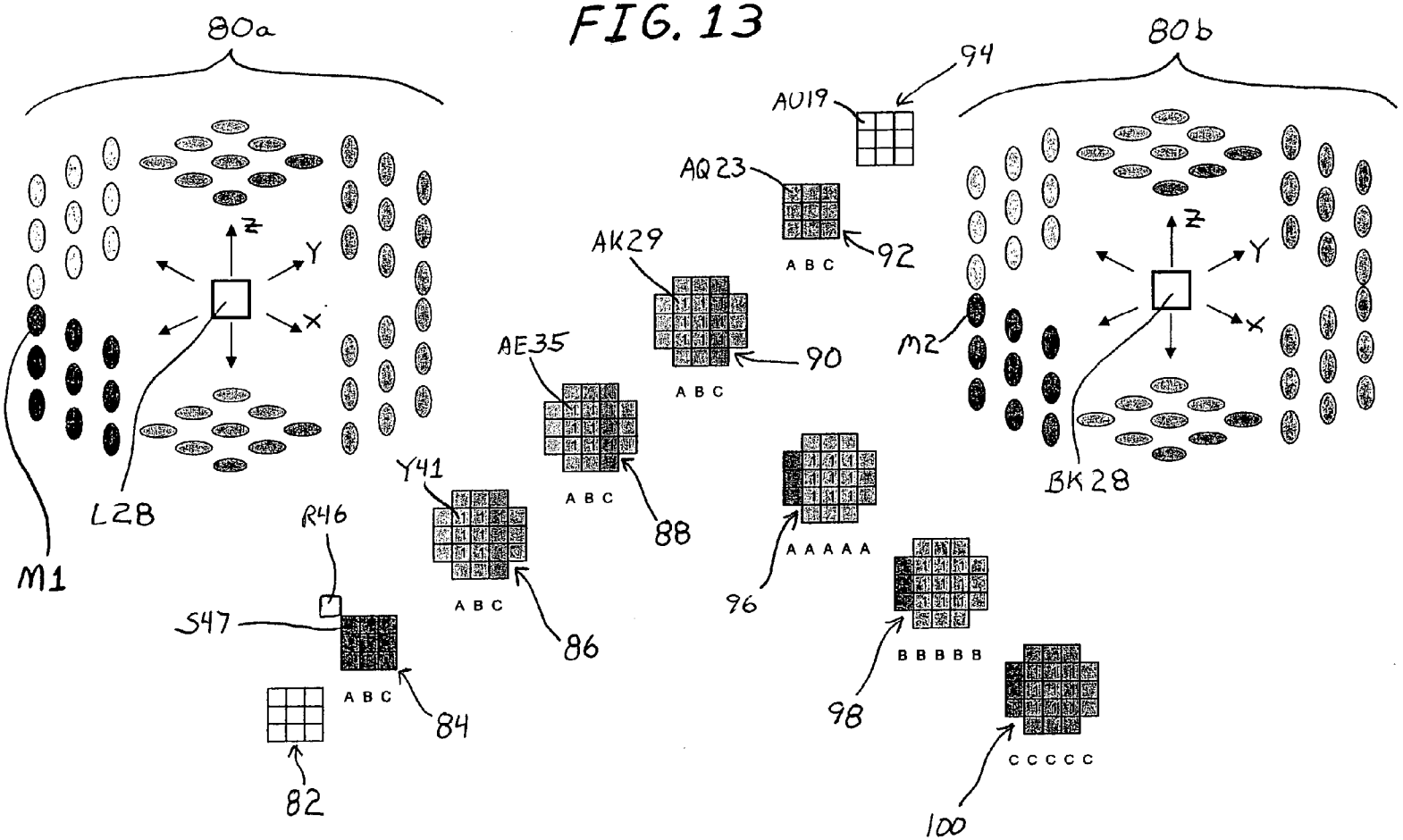
FIG. 13 shows the game of FIG. 12 with the spreadsheet gridlines removed.

The game of the present invention may also be modeled electronically, such as with a computer spreadsheet program. A spreadsheet model of the game is shown schematically in FIG. 12. The same model is shown in FIG. 13 with the spreadsheet gridlines removed. The model includes two 3-dimensional representations of the game playing surfaces, one for each player or team, shown generally as play areas 80*a* and 80*b*. Each play area comprises 6 arrays of 9 ellipses, or pushbuttons, which represent the 6 face arrays in the physical embodiment of the game. Play areas 80*a* and 80*b* also comprise scoring cells L28 and BK28, respectively, which store the players' scores. By clicking or selected one of the pushbuttons with a mouse or other pointing device, a player may initiate a move. Pushing a particular pushbutton in the computer model is equivalent to inserting the pilot cube into the face array location represented by the pushbutton.

The internal configuration of the physical game is modeled as a series of cell arrays in the spreadsheet. Cell arrays 84, 86, 88, 90 and 92 represent successive "slices" through the physical game perpendicular to the Y-axis. Cell arrays 84 and 92 represent opposite face arrays. Cell arrays 86, 88 and 90 each comprise a central area of 9 cells representing a "slice" through the center array, and 4 groups of 3 cells each, representing sections of each of the remaining face arrays. Cell arrays 96, 98 and 100 represent successive slices through the center array perpendicular to the X-axis. Cell arrays 82 and 94 are provided to act as "holding" cells for scoring moves.

Blank cubes are represented by a null or zero value, and scoring cubes are represented by a unit value. The movement of the playing cubes, and more particularly the locations of the scoring cubes, are modeled and tracked by the spreadsheet by moving the values from cell to cell. There are 108 possible moves, which is equal to the number of available pushbuttons. Each move is managed by a macro which moves values from cell to cell according to an algorithm which models the physical games. At the start of the game, all the cells representing the center array are assigned a value of 1. The cells representing the side arrays, as well as holding arrays 82 and 94, and the 2 scoring cells, are initially set to zero. Referring to FIG. 13 and the macro shown in FIG. 14, a sample move is described for Player 1 (playing on the left play area).

Player 1 selects pushbutton M1 on play area 80*a*. The value of AQ23 is moved to AU19. The value of AU19 is added to the current value of scoring cell L28, such that L28 represents a cumulative score for Player 1. In this instance, no score was achieved on this move. The value of AK29 is moved to AQ23, the value of AE35 is moved to AK29, the value of Y41 is moved to AK29, and the value of S47 is moved to Y41. The last step in the macro is to assign S47 a null value, since the macro is modeling insertion of the non-scoring pilot cube into the physical game. To accomplish this, the value of R46 (always null) is moved to S47. Note that AQ23, AK29, and AE35 now all have a value of 1, and Y41 and R46 have a value of zero.

Referring now to FIG. 13 and the macro shown in FIG. 15, Player 2 selects pushbutton M2 on play area 80*b*. Note that this button represents the same move as pushbutton M1, except that any score goes to Player 2. The macro proceeds in similar fashion to that described above. Note, however, that since AQ23 has a value of 1, this value is moved to AU19 and then added to the current value of BK28. Therefore, Player 2 receives a score of 1 for this move. Similar macros manage moves initiated by the other pushbuttons, and calculate the new configuration of the cells, including the score, after each move.

Figure 16:
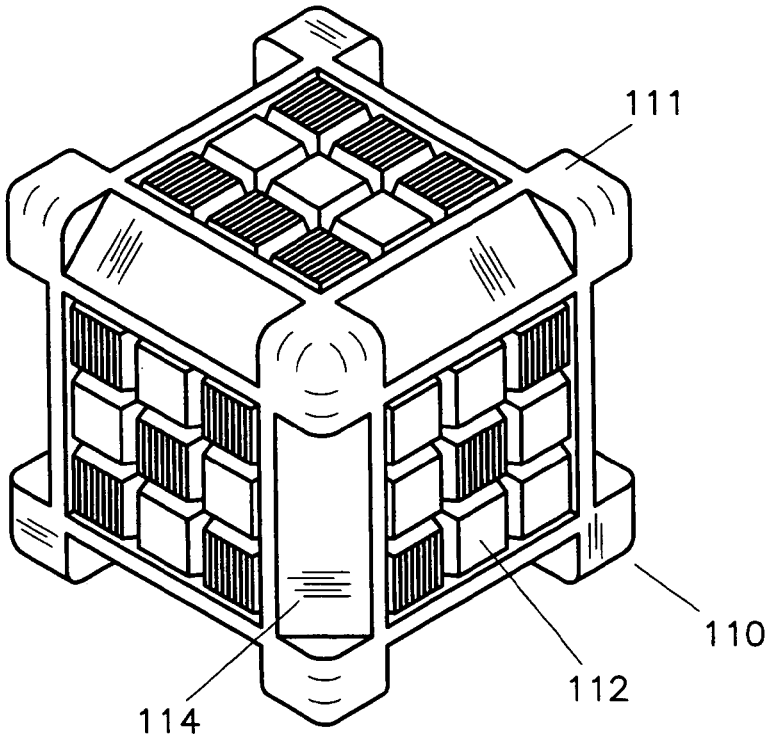
FIG. 16 shows an isometric view of an electronic version of the game having a cube configuration with input buttons on each face.

The algorithms used in the above spreadsheet based game may also be programmed into a variety of handheld electronic games which duplicate the physical game. FIG. 16 shows a handheld electronic game 110 comprising a generally cubic base 111 having an array of 9 finger buttons such as 112 on each side. Selecting one of the buttons would be the equivalent of inserting a cube into the frame at that particular location in the mechanical game. The frame also comprises one or more display/input panels 114, disposed at the edges of the frame. The panels may display information such as the score, current player ID, active face, etc. The panel 114 may also comprise input means which allow the user to input data such as desired face and location of move, player ID, etc. The display may also include an electronic die for selecting the face for the next move at random. The electronic die comprises a numeric display which displays the numerals 1 through 6 in successive or random order, at a rate too fast for the human eye to track. An input device allows a player to halt the numeric display at an essentially random spot.

Figure 17:
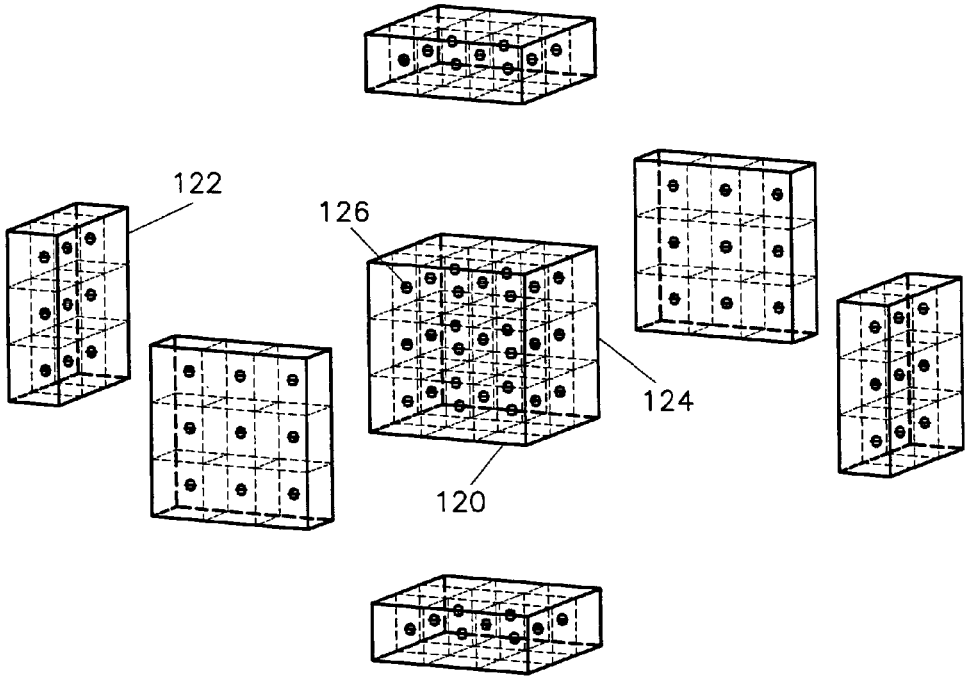
FIG. 17 shows an exploded isometric view of an alternative electronic version of the game comprising transparent cubes containing LEDs.
Figure 18:
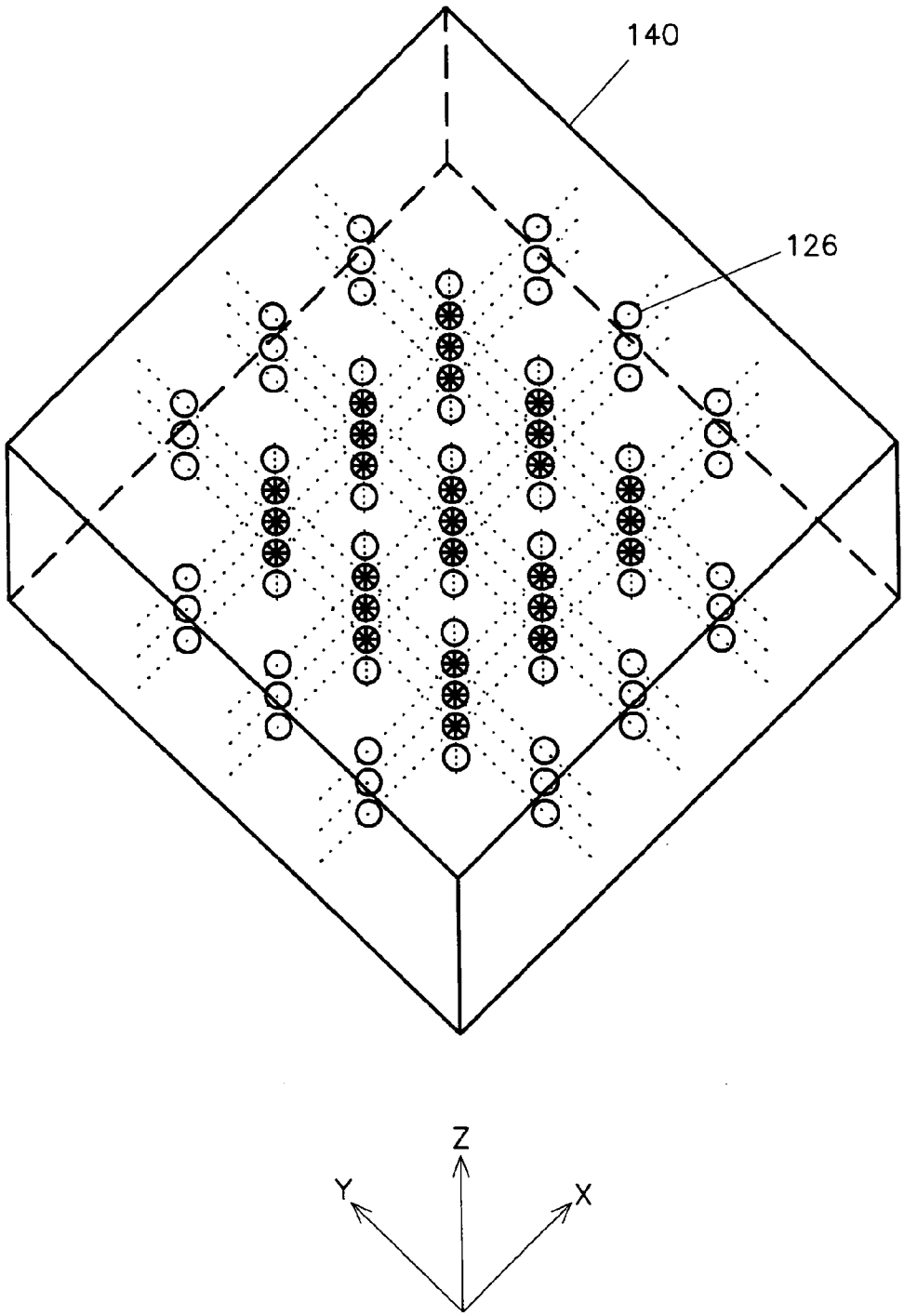
FIG. 18 shows an assembled isometric view of the LED array for the game shown in FIG. 17.

FIG. 18 shows another handheld electronic embodiment of the game comprising an essentially transparent cube 140 containing an array of LEDs or other electrically powered lighting devices 126. In FIG. 17 the LEDs are shown in exploded view to represent the center array 120 and the face arrays such as 122, as in the physical game. In other embodiments the actual game could be structured as shown in FIG. 17, with the face arrays separated from the center array for better visibility. The face arrays would be mounted in separate face frames and the center array would be mounted in a center frame. The game also comprises a lattice of wires 124 providing electricity to the LEDs. During play, the virtual location of the "scoring cubes" could be represented by providing power to the LEDs. The location of the lights would move through the game during play, representing movement of the cubes in the mechanical version of the game.

Figure 19:
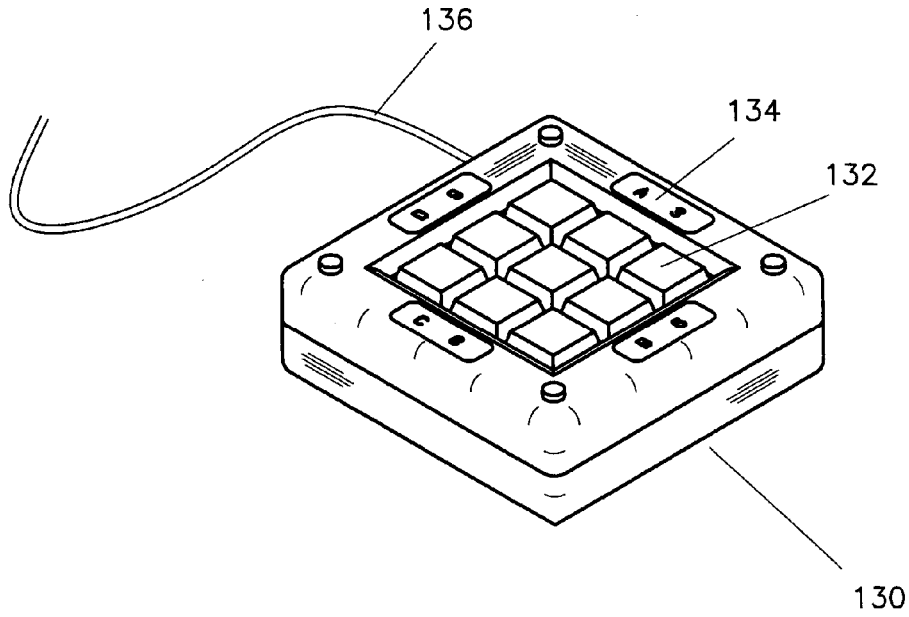
FIG. 19 shows a remote input and display device for use with the games shown in FIGS. 16 through 18.

The game of FIGS. 17 and 18 could also be provided with an array of buttons or other touch sensitive devices mounted on the sides of the game and corresponding to side arrays of the mechanical game. Selecting one of the buttons would be the equivalent of inserting a cube into the frame at that particular location. Any of the computer or electronic versions of the game may also include one or more remote input devices 130 as shown in FIG. 19. Device 130 can include a keypad 132 for use by the players to input data or select moves. Device 130 can also include one or more display panels 134 for displaying game or player information. Device 130 could be networked to the game and to other such devices through cable 136. In other embodiments, the keypad 132 and/or display 134 could be replaced by a touchscreen or similar device. Any of the computer or electronic versions of the game could also include sound effects for indicating various game conditions, end of turn, scoring, etc.

Figure 32:
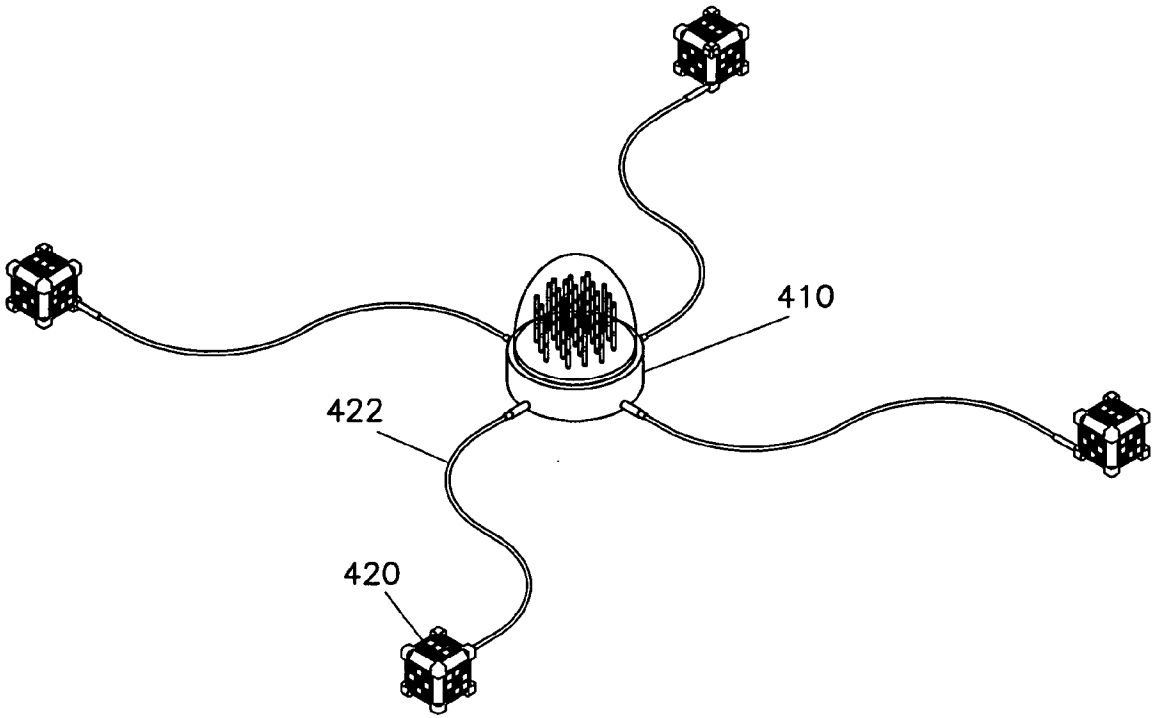
FIGS. 32 and 33 show isometric views of an alternative LED-based version of the game.
Figure 33:
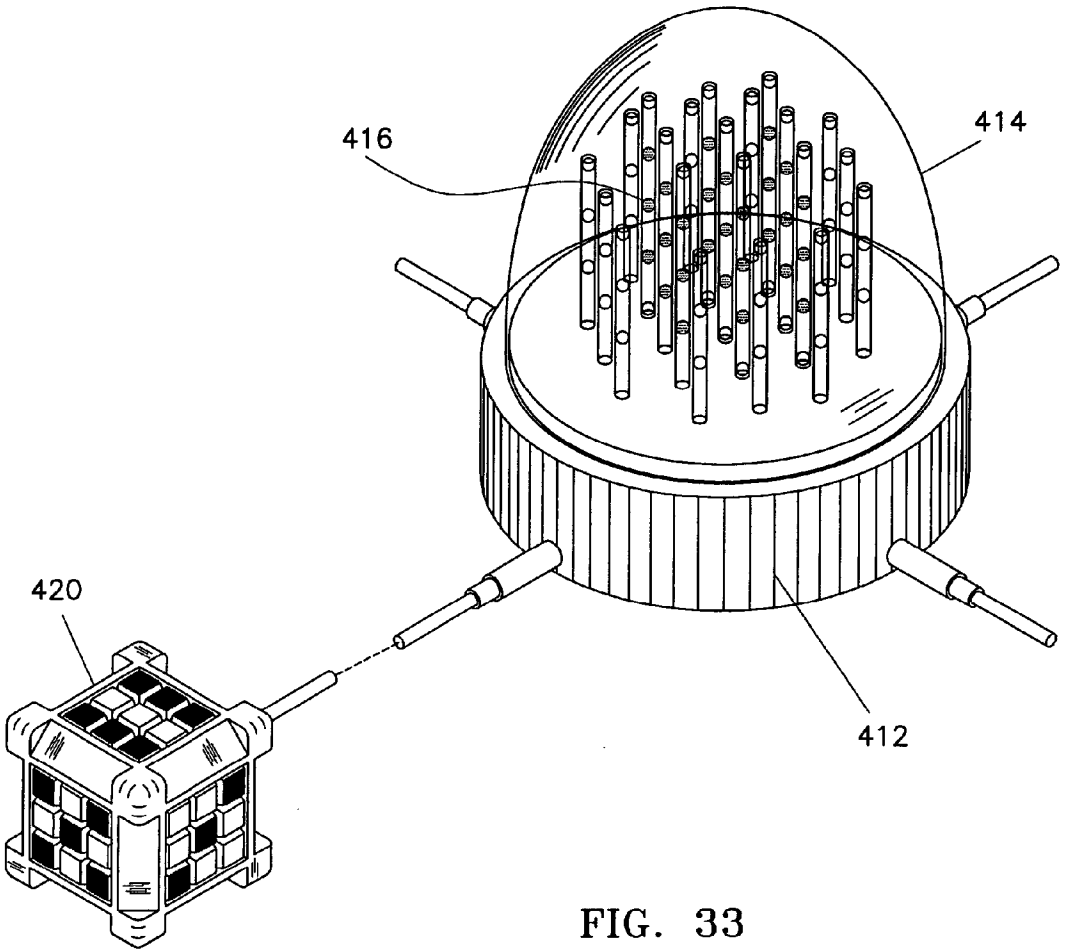

FIGS. 32 and 33 show an alternative version of the game including a game display 410 and a plurality of handheld controllers 420 connected to the display 410 via cables such as 422. In other embodiments the controllers 420 may be connected to the display 410 by a wireless network or other suitable connection. The controllers may be similar to those shown in FIG. 16 or FIG. 19. The display 410 may include a base 412, a game simulation portion 416, and a cover 414. The simulation portion 416 may comprise a number of LED's as described above with respect to other embodiments of the invention. Alternatively, the simulation portion 416 may comprise a plurality of fiber optic cables, or any other suitable visible electronic means. Cover 414 may comprise a thin, substantially transparent shell of plastic or other suitable material. The shape of cover 414 may be selected to reduce or eliminate glare from the simulation portion. Preferably the cover 414 is semi-ellipsoid in shape. In other embodiments the cover may be fashioned from a solid block of substantially transparent material, with the visible electronic means embedded or cast within the block, or inserted into holes drilled into the block.

Figure 31:
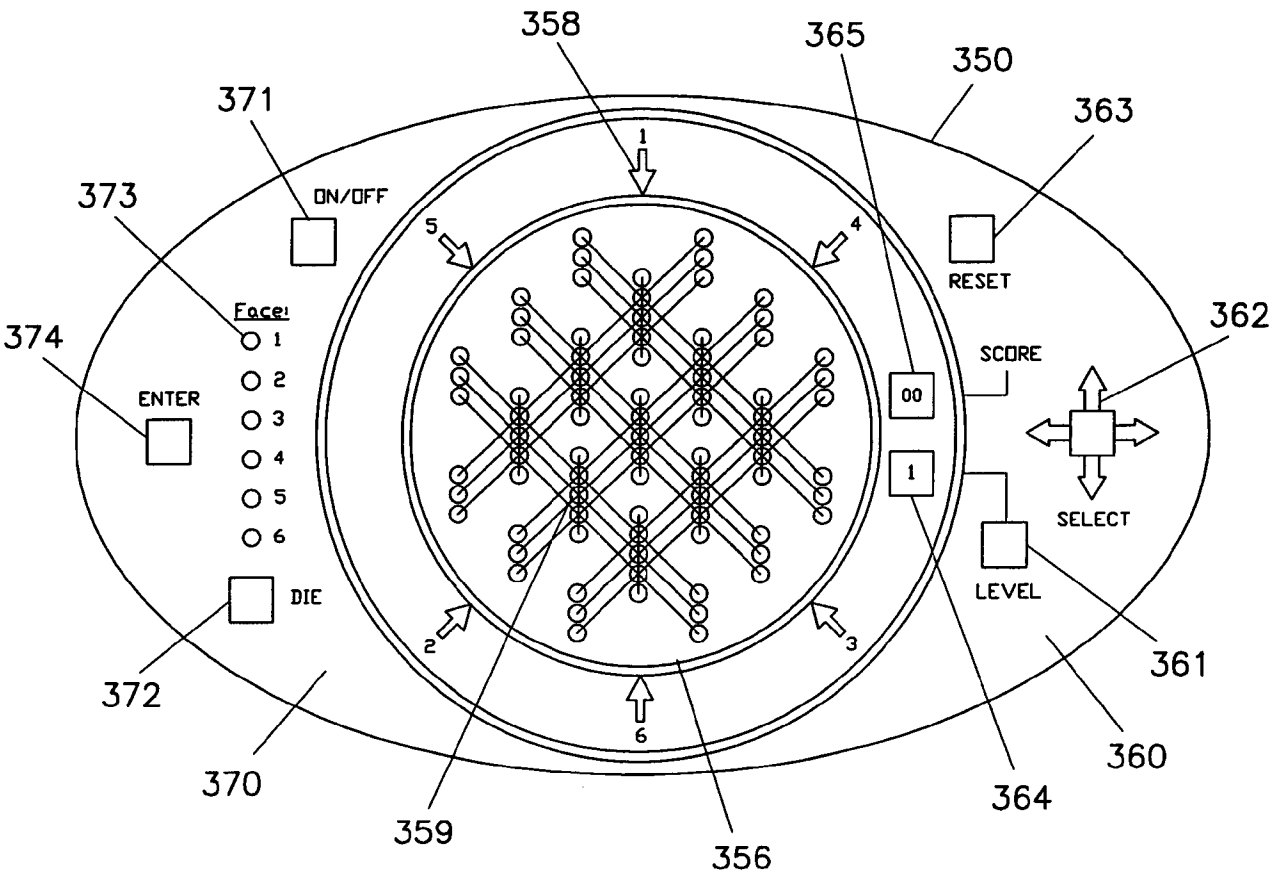
FIG. 31 show a plan view of a handheld electronic version of the game.

FIG. 31 shows an alternative handheld version of the game 350. The game 350 includes a body or case 360, a visual display 356, and a plurality of control buttons. The visual display 356 may be a visual representation 359 of any of the mechanical, LED based, or electronic versions of the game disclosed herein. The display may include face indicators 358 and 373. The handheld version of the game may include an on/off button 371, a reset button 363 for starting a new game, and an enter button 374 for entering any selections made with any of the other buttons. The game may also include a score display 365, a skill level display 364, and a skill level selection button 361. The game may also include a select button 362 for selecting a cube face for play, or for selecting any other appropriate game parameters. The game may also include an electronic die button 372, which may be used to randomly select the cube face for play. Face indicators 373 and 358 may be selectively lit or otherwise highlighted, to indicate which face is active or selected either by the die button 372 or the select button 362. In alternative embodiments, commands may be entered via touch sensitive buttons, or by verbal commands interpreted by voice recognition software within the game.

Figure 30:
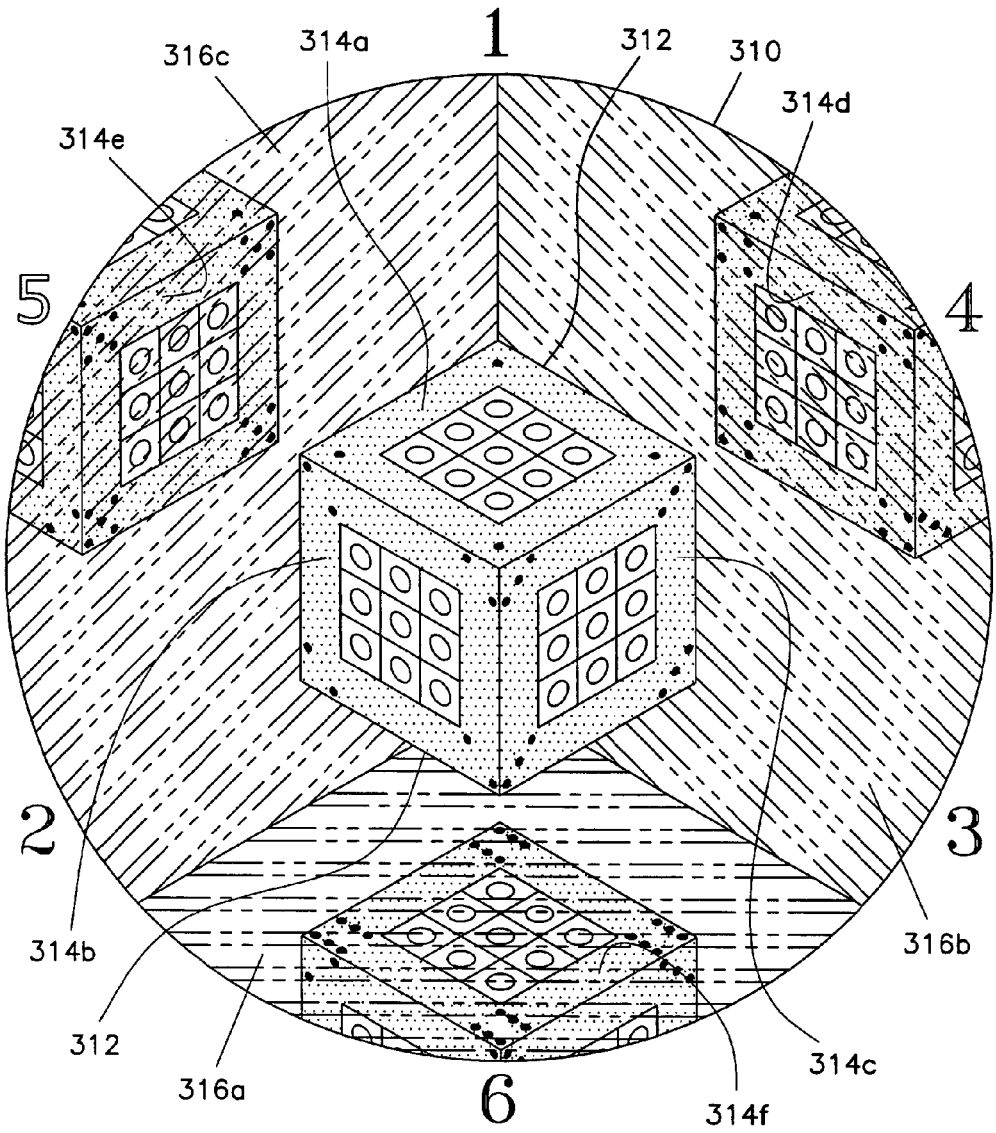
FIG. 30 shows a simulated mirror display for an electronic version of the game.

FIG. 30 shows a possible visual display for any of the electronic versions of the game described herein. The display 310 comprises a visual representation of the mechanical game 312, showing faces one, two and three, indicated at 314*a*, 314*b* and 314*c* respectively. Three simulated, or virtual, mirrors are displayed to provide a visual representation of the three faces of the game not directly visible. Face four of the game is shown at 314*d* in simulated mirror 316*b*. Face five of the game is shown at 314*e* in simulated mirror 316*c*. And finally, face six of the game is shown at 314*f* in simulated mirror 316*a*.

It should be noted that the numbering of the game faces differs slightly from the numbering of standard gaming die. In a standard die, the values of any two opposite faces add up to seven. In the present invention, the positions of faces 4 and 5 have been interchanged. The purpose of this change is to make each successively numbered face of the game adjacent to the previous face. Under certain rules of play, the faces for inserting cubes may be selected in numerical order, and it is desirable to not insert cubes into opposing faces on successive turns.

The electronic version of the game may also be modeled for play over the Internet or telephone. The game may be played as a spectator type game, where the spectators know the internal configuration of the game, but the players do not. The players may also be asked to answer trivia type questions corresponding to each move, or the scoring buttons could represent questions which must be answered before the score is awarded. All of the above electronic or physical versions of the game may include the electronic die. A time limit for moving may also be established for the electronic or physical embodiments of the game.

The game may be converted to a casino type game, where the value of the cubes represent cash prizes or bets by the players. In one casino version of the game, the bets of individual players could be provided with means for identifying which player initiated the bet. If a player receives his own bet back during his or her turn, he may be awarded a multiple of his original bet from the house. If a player receives another players bet, the receiving player would be awarded the face value of the bet. A time limit could be set for the overall game, after which time limit the house retains all un-awarded bets. The concept of placing "bets" which are identified with particular players, and the concept of awarding a multiple of the original bet to the original better, can also be applied to any of the physical or electronic versions of the game.

Figure 34:
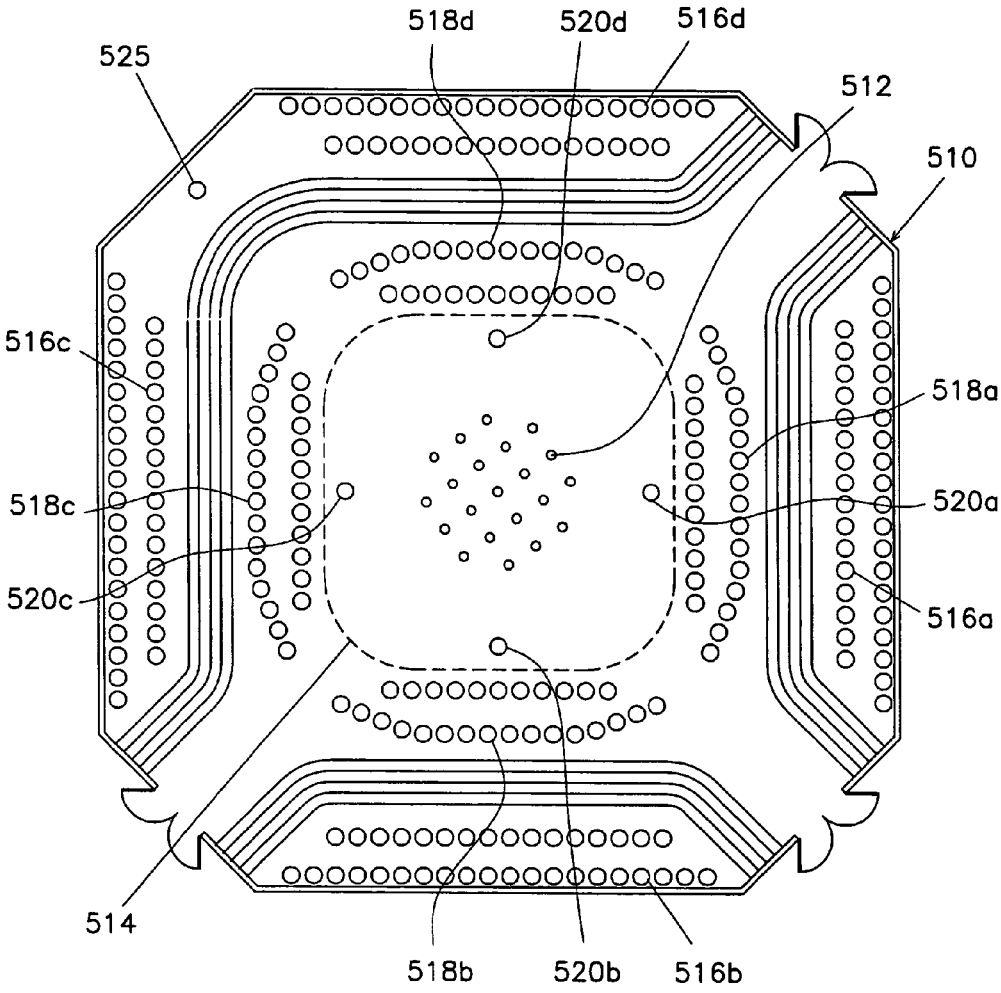
FIG. 34 shows an overhead view of a studio version of the game.
Figure 35:
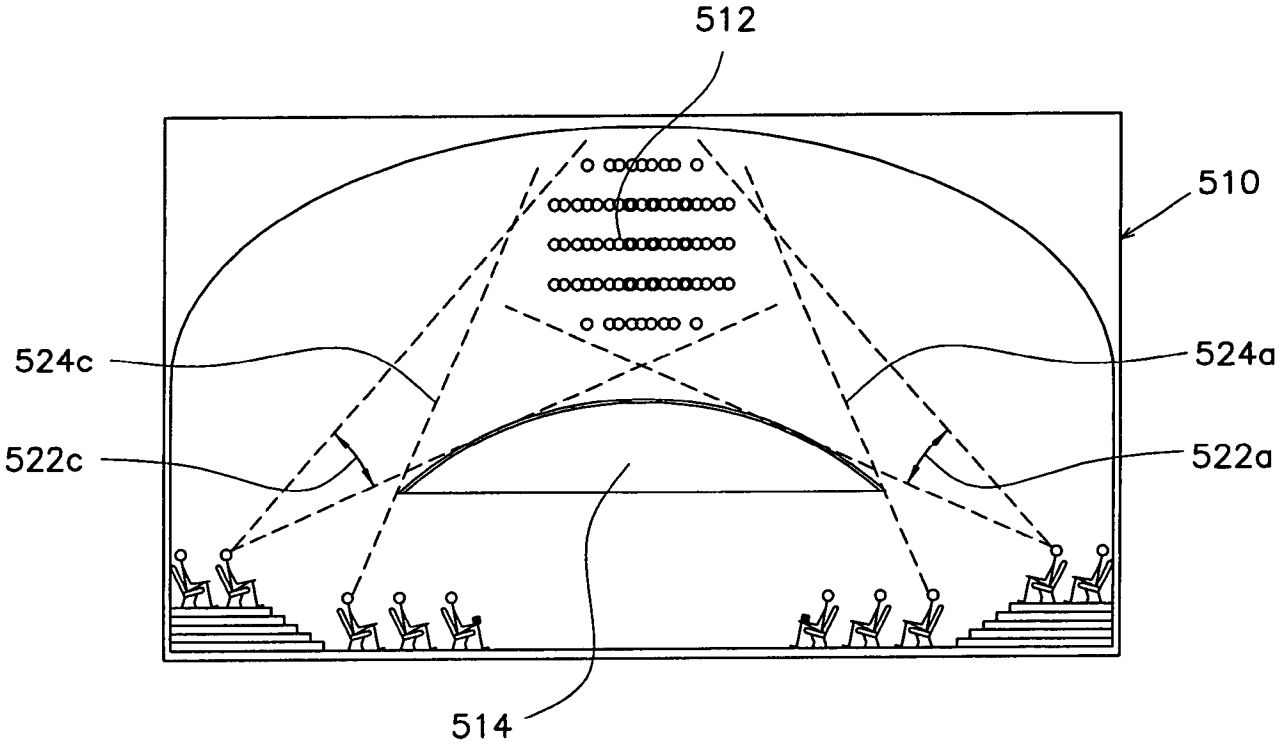
FIG. 35 shows a side view of the studio version of the game shown in FIG. 34.

The game may also be adapted for play as a studio game show, for possible television broadcast. FIGS. 34 and 35 show a possible configuration for such a studio type game. The studio 510 includes a 3-dimensional electronic visual display of the game 512, which may be suspended from the ceiling of the studio. An opaque shield 514 is disposed below the visual display. A studio audience may be divided into four groups 516*a* through 516*d*, and an announcer or master of ceremonies 525 may also be provided. Four players 520*a* through 520*d* are seated near the center of the studio and are provided with a game control module. Behind each player is seated a helper group 518*a* through 518*d*, each helper group having 27 members each. One member of each helper group is associated with each of the 27 positions within the center array of the game.

Referring to FIG. 34, the shield 514 prevents the players 520*a*-520*d* and the helper groups 518*a*-518*d* from seeing the game display 512. The display is outside the visual range 524*c* of helper group 518*c*, and also out of the visual range 524*a* of helper group 518*a*. The display is similarly out of the visual range of the other helper groups. The display is within the visual range 522*a* of audience group 516*a*, and within the visual range 522*c* of audience group 516*c*. The display can also be seen by the other audience groups and the announcer 525.

During play, the function of each member of the helper groups is to keep track of whether there is a score or light associated with their assigned position within the center array. Each helper group may then advise their associated player as to which move to make. In different embodiments, the helper groups may collaborate and make a single recommendation to their player, or they may make individual recommendations. The recommendations may be verbal or electronic, and may be made publicly or in confidence. The remainder of the rules of play may include any of the rules discussed above.

Figure 36:
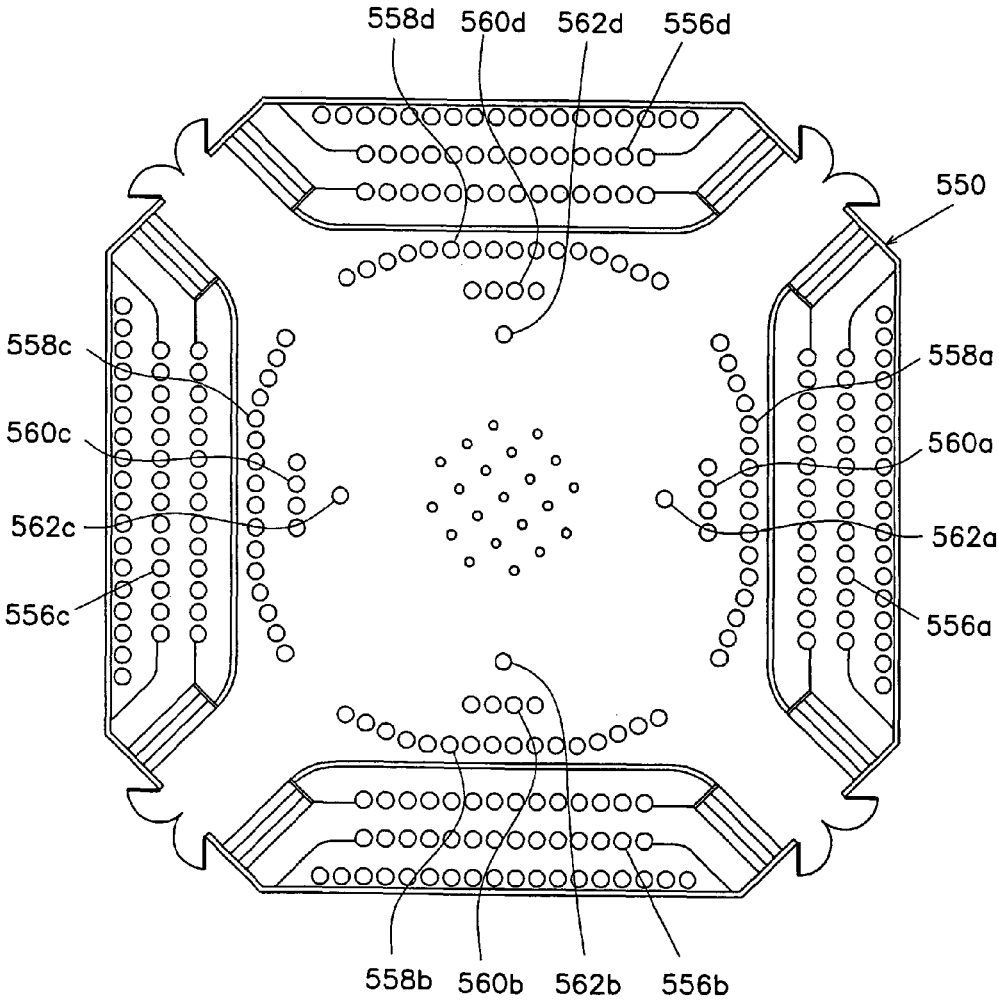
FIG. 36 shows a overhead view of an alternative studio version of the game.
Figure 37:
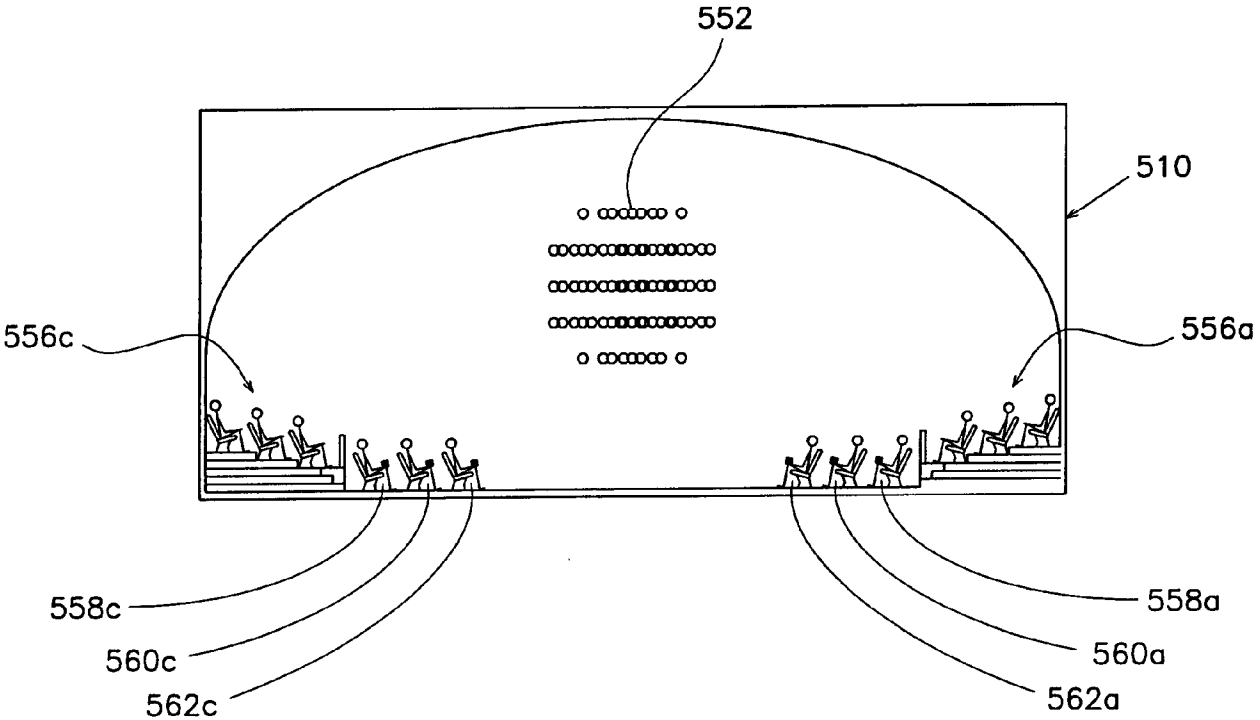
FIG. 37 shows a side view of the studio version of the game shown in FIG. 36.

FIGS. 36 and 37 show an alternative version of the game adapted for play as a studio game show. In this embodiment, the studio 550 again includes a visual electronic display of the game 552, which is visible to all persons in the studio. A studio audience is divided into four groups 556*a* through 556*d*. The studio further comprises a number of center seats arranged as follows. Four seat groups 558*a*-558*d* of 16 seats each are arranged in front of the audience groups. Four seat groups 560*a*-560*d* of four seats each are arranged in front of groups 558*a*-558*d*. Finally, four single seats 562*a*-564*d* are arranged in front of groups 560*a*-560*d*. Each audience seat and center seat may be provided with a game control module At the beginning of play, the groups of seats in the center are empty. In a first round of play, the audience members may play the game under any of the possible rule variations. According to predetermined parameters, at the end of the round the best 64 players are selected to move on to the second round. These 64 players then move to seat groups 558*a*-558*d*. In another embodiment 64 players may be selected at random from the audience for this round. For the second round, the 64 players are divided into four teams of 16 players each. Each of groups 558*a*-558*d* may comprise a team, or every fourth player may belong to the same team, or the teams may be chosen at random. The four teams play the game under any of the possible rule variations, and according to predetermined parameters, the winning team of 16 moves on to the third round. These players then move to seat groups 560*a*-560*d*.

For the third round, the 16 players are divided into four teams of 4 players each. Again, each of groups 560*a*-560*d* may comprise a team, or every fourth player may belong to the same team, or the teams may be chosen at random. The four teams play the game under any of the possible rule variations, and according to predetermined parameters, the winning team of four moves on to the final round. These players then move to seats 562*a*-562*d*. For the final round, the four final players play the game under any of the possible rule variations, until there is a final winner.

Figure 38:
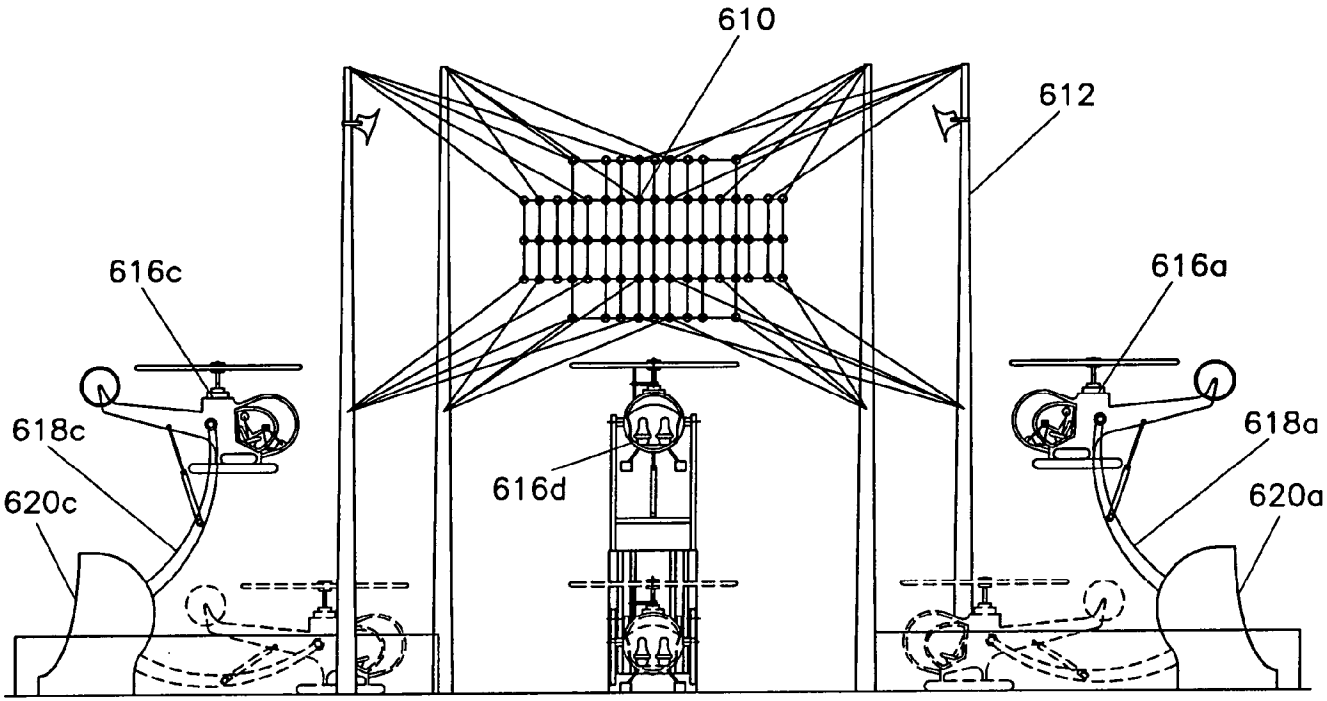
FIG. 38 shows an elevation of a theme park version of the game.
Figure 39:
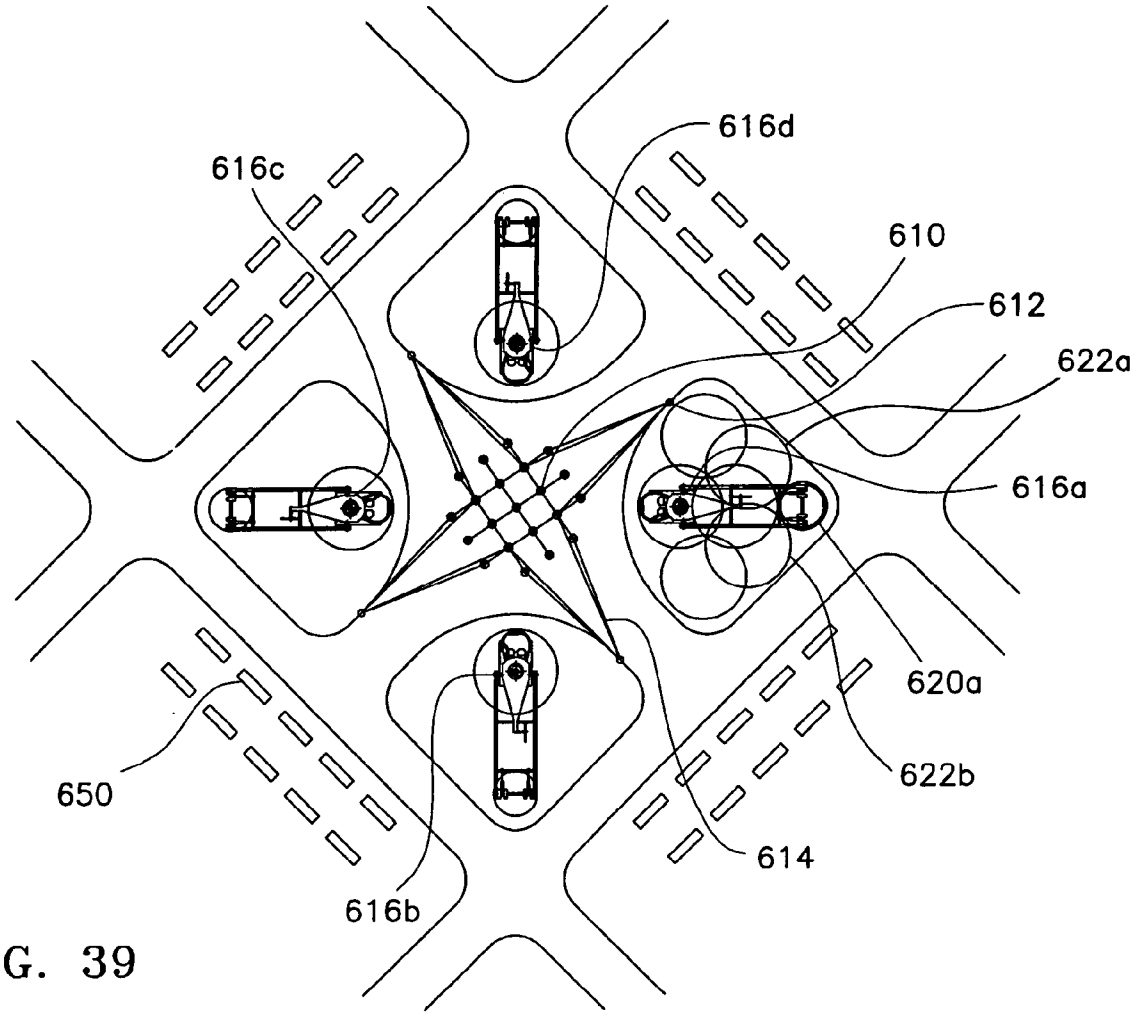
FIG. 39 shows an overhead view of the theme park version of the game shown in FIG. 38.
Figure 40A:
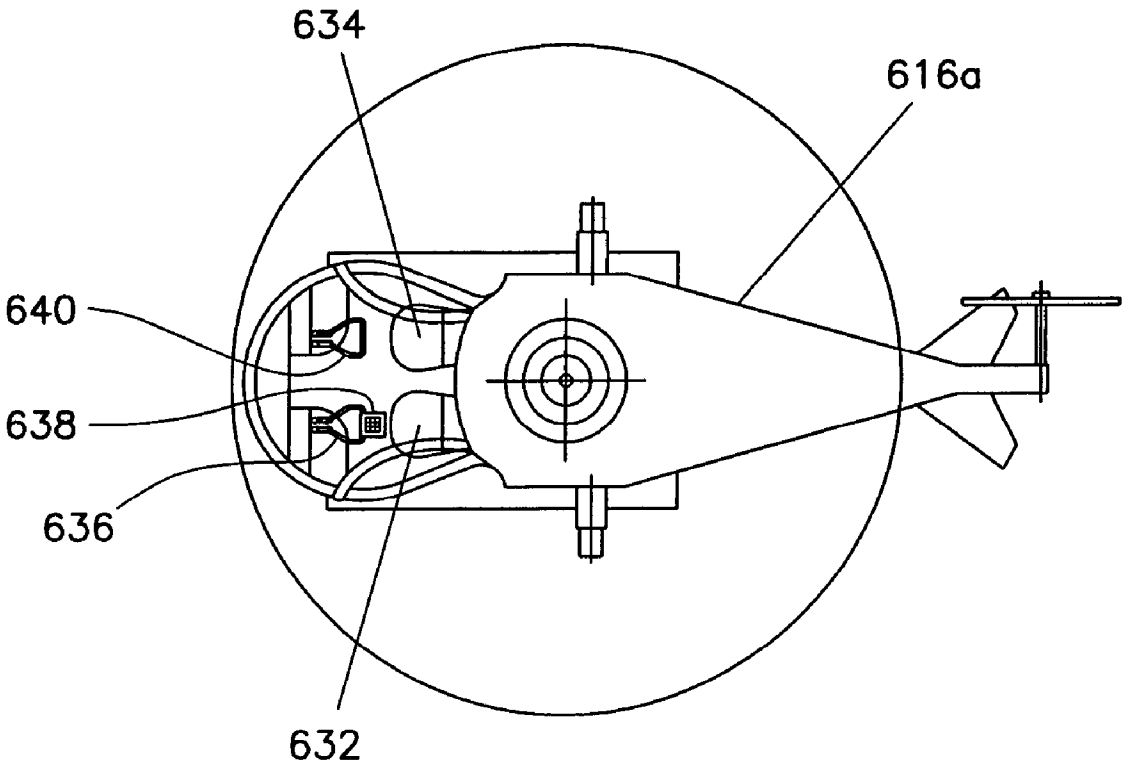
FIGS. 40*a* through 40*c* show various views of a player control capsule for the theme park version of the game shown in FIG. 38.
Figure 40B:
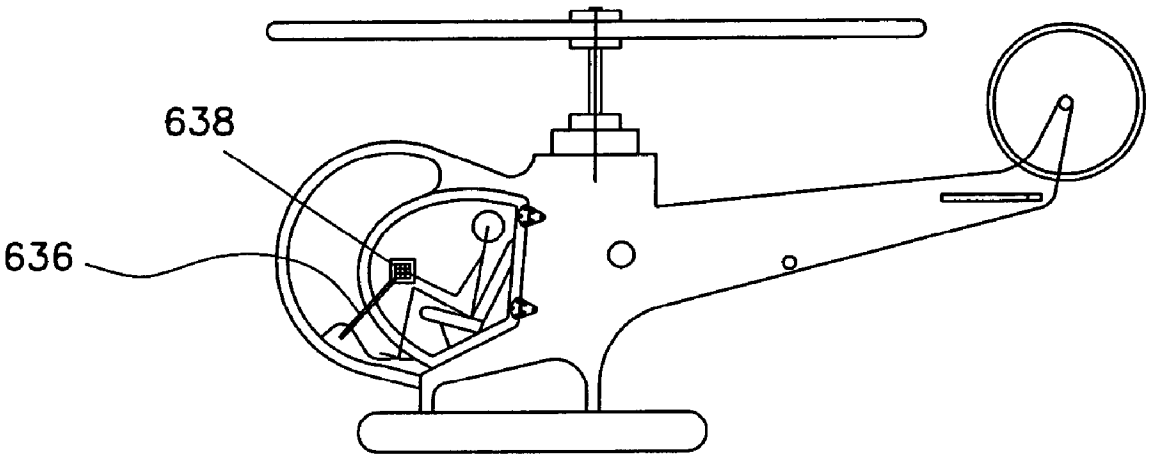
Figure 40C:
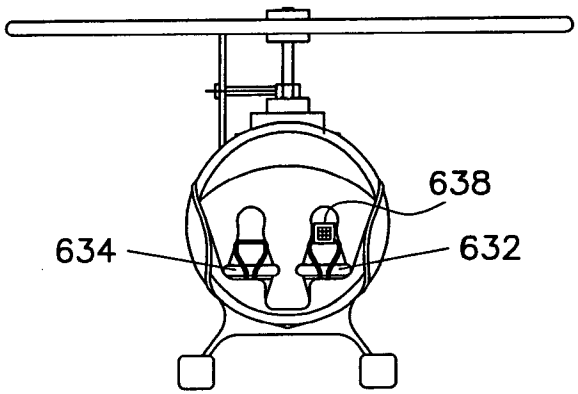

FIGS. 38 and 39 show a version of the game adapted for installation in a theme park. The game comprises a visual electronic display 610, which may be suspended from poles such as 612 and cables 614. The game comprises up to four player control capsules 616*a* through 616*d*. In the illustrated embodiment the control capsule comprise a mock helicopter, but in other embodiments any suitable configuration may be used for the control capsules. Each control capsule such as 616*a* is supported by a support arm such as 618*a*, which may be maneuvered by lifting mechanism 620*a*. In FIG. 38, each capsule is shown in its upper position, with the lower position shown in dashed lines. Referring to FIG. 39, each capsule such as 616*a* may also be maneuvered side to side by lifting mechanism 620*a*, to maximum positions 622*a* and 622*b*. Referring to FIGS. 40*a* through 40*c*, each capsule may comprise a player seat 632 having a player handle 636, and a passenger seat 634 having a passenger handle 640. The player handle 636 may further comprise a control module 638, with which the player may (1) play the game, and (2) control the position of the capsule so that she can most advantageously see the game display. An audience viewing area 650 may be provided. Alternatively, the passenger handle 640 may be adapted to control the position of the capsule.

It should be recognized that, while the present invention has been described in relation to the preferred embodiments thereof, those skilled in the art may develop a wide variation of structural and operational details without departing from the principles of the invention.

The invention claimed is:

1. An electronic insertion type game system, comprising:

an electronic display;

computer means in communication with said electronic display programmed to display a three dimensional image of a larger game cube formed of a plurality smaller cubes arranged in a generally cubic center array having six square faces representing scoring cubes, at least one of which has a value and a second plurality of smaller cubes arranged in six generally square side arrays representing non-scoring cubes, each said side array being approximately the same size as said square faces of said center array;

at least one input means selected from the group consisting of a mouse, a hand-held controller device, a touch sensitive device, and a voice recognition device in communication with said computer means operated by at least one player for selection of particular cubes of said side arrays, and said computer means programmed to illuminate or darken particular cubes of said side arrays and said center array responsive to said input means to represent inserting a said non-scoring cube in the corresponding location in said side array of said game cube image, resultant relative movement of said scoring cubes in said center array, and ejection of a said scoring cube from an opposed one of said side arrays; wherein said input means is operated by a first player to illuminate a selected said smaller cube of a first one of said side arrays to represent inserting a said non-scoring cube in the corresponding location, and said computer means illuminates or darkens said smaller cubes at locations of said center array and an opposed one of said side arrays to represent movement of said scoring cubes and ejection of a said scoring cube from an opposed one of said side arrays;

thereafter, said input means is operated by a second player to illuminate a selected said smaller cube at a location on another one of said side arrays to represent inserting a said non-scoring cube in the corresponding location, and said computer means illuminates or darkens said smaller squares at locations in said center array and an opposed one of said side arrays to represent movement of said scoring cubes and ejection of a said scoring cube from an opposed one of said side arrays; and upon said computer means illuminating or darkening said opposed one of smaller cubes of said side arrays representing ejection of a said scoring cube having a value, the value is added to the score of the player causing ejection of said scoring cube having a value.

2. The electronic insertion type game system according to claim 1, wherein said computer means is programmed to display three dimensional image of said larger game cube such that a first set of three faces of said larger game cube are visible and a second set of three faces of said game cube are not visible, and at least one simulated mirror image in which at least one of said second set of faces is visible.

3. The electronic insertion type game system according to claim 1, wherein said computer means is programmed to display three dimensional image of said larger game cube such that a first set of three faces of said larger game cube are visible and a second set of three faces of said game cube are not visible, and three simulated mirror images in which each of said faces of said second set of faces is visible.

4. The electronic insertion type game system according to claim 1, wherein said at least one input means is a hand-held controller device remote from said central unit.

5. The electronic insertion type game system according to claim 1, wherein said electronic display is mounted in a studio having an audience seating area and at least one player station; and said at least one input means is disposed at said at least one player station.

6. The electronic insertion type game system according to claim 1, wherein said electronic display is mounted in a theme-park having an audience viewing area and at least one player station; and said at least one input means is disposed at said at least one player station.

7. The electronic insertion type game system according to claim 6, wherein said at least one player station comprises a capsule which is selectively movable relative to said electronic display.

8. The electronic insertion type game system according to claim 1, wherein said electronic display is housed in a central unit; and said at least one input means is a hand-held controller device connected with said central unit by a wireless network.

9. The electronic insertion type game system according to claim 1, wherein said at least one input means comprises at least one touch-screen.

10. The electronic insertion type game system according to claim 1, wherein said at least one input means comprises a voice recognition device for accepting verbal commands.

11. The electronic insertion type game system according to claim 1, further comprising:

audio means connected with said computer means for producing sound effects.

12. The electronic insertion type game system according to claim 1, wherein said electronic display, said computer means, and said at least one input means are housed within a hand-held device.

* * * * *